US008177484B2

(12) United States Patent
Haraguchi et al.

(10) Patent No.: US 8,177,484 B2
(45) Date of Patent: May 15, 2012

(54) IMPELLER OF MULTIBLADE BLOWER AND METHOD OF MANUFACUTURING THE SAME

(75) Inventors: Kazuya Haraguchi, Kusatsu (JP); Yoshinori Kagawa, Kusatsu (JP); Hideshi Tanaka, Kusatsu (JP); Kouzou Yoshinaga, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 1098 days.

(21) Appl. No.: 12/066,705

(22) PCT Filed: Sep. 26, 2006

(86) PCT No.: PCT/JP2006/319022

§ 371 (c)(1),
(2), (4) Date: Mar. 13, 2008

(87) PCT Pub. No.: WO2007/037216

PCT Pub. Date: Apr. 5, 2007

(65) Prior Publication Data

US 2009/0290986 A1 Nov. 26, 2009

(30) Foreign Application Priority Data

Sep. 28, 2005 (JP) ..... 2005-281729

(51) Int. Cl.
*F04D 5/00* (2006.01)

(52) U.S. Cl. ..... 415/53.1; 416/241 A; 416/178; 416/228; 416/DIG. 2; 416/235; 416/236 R; 416/237

(58) Field of Classification Search ..... 415/53.1, 415/53.2, 53.3; 416/241 A, 178, 184, 228, 416/DIG. 2, 235, 236 R, 236 A, 237
See application file for complete search history.

(56) References Cited

U.S. PATENT DOCUMENTS 6,592,329 B1 7/2003 Hirose et al.

FOREIGN PATENT DOCUMENTS

| | | | | |
|---|---|---|---|---|
| DE | 43 35 686 | A1 | | 4/1995 |
| EP | 1 184 574 | A2 | | 3/2002 |
| GB | 2 283 060 | A | | 4/1995 |
| JP | 03-189398 | A | | 8/1991 |
| JP | 06101697 | A | * | 4/1994 |
| JP | 06262644 | A | * | 9/1994 |
| JP | 10148196 | A | * | 6/1998 |
| JP | 10-252689 | A | | 9/1998 |
| JP | 11-141494 | A | | 5/1999 |
| JP | 11141494 | A | * | 5/1999 |
| JP | 2000-045994 | A | | 2/2000 |
| JP | 2002-347080 | A | | 12/2002 |
| JP | 2004-124819 | A | | 4/2004 |

(Continued)

*Primary Examiner* — Edward Look
*Assistant Examiner* — Adam W Brown
(74) *Attorney, Agent, or Firm* — Global IP Counselors

(57) ABSTRACT

An impeller of a blower is disposed with circular support plates that are made of a resin and rotate about an axis of rotation and a plurality of blades that are made of a resin. The blades are disposed on outer peripheral portions of the circular support plates so as to be parallel to an axis of rotation, and serrated shapes are formed on the blades by cutting out blade tips at plural places. Additionally, a step is formed in a blade face of each of the blades at a position a predetermined distance from the blade tip where the serrated shape is formed.

15 Claims, 16 Drawing Sheets

FOREIGN PATENT DOCUMENTS

| | | | | |
|---|---|---|---|---|
| JP | 2004124819 | A | * | 4/2004 |
| JP | 2006-306033 | A | | 11/2006 |
| RU | 2 059 114 | C1 | | 4/1996 |
| RU | 2 135 837 | C1 | | 8/1999 |
| RU | 22978 | U1 | | 5/2002 |
| RU | 2 254 497 | C1 | | 6/2005 |

* cited by examiner

IMPELLER OF MULTIBLADE BLOWER AND METHOD OF MANUFACUTURING THE SAME

CROSS-REFERENCE TO RELATED APPLICATIONS

This U.S. National stage application claims priority under 35 U.S.C. §119(a) to Japanese Patent Application No. 2005-281729, filed in Japan on Sep. 28, 2005, the entire contents of which are hereby incorporated herein by reference.

TECHNICAL FIELD

The present invention relates to an impeller of a multiblade blower and a method of manufacturing the same.

BACKGROUND ART

Conventionally, there has been an impeller of a multiblade blower where a plurality of blades are disposed on outer peripheral portions of circular support plates so as to be parallel to an axis of rotation of the circular support plates. In such an impeller of a multiblade blower, oftentimes noise that arises due to an airflow passing through the blades configuring the impeller becomes a problem.

In order to reduce such noise, an impeller structure has been proposed where serrated shapes are formed on blade tips of the blades configuring the impeller to thereby prevent separation of the airflow on negative pressure surfaces of the blades, reduce vortexes that occur on the rear edges of the blades, and reduce noise (see JP-A No. 11-141494).

SUMMARY OF THE INVENTION

However, the impeller of a multiblade blower having the above-described structure is manufactured by preparing the plurality of blades on whose blade tips are formed the serrated shapes and the circular support plates and then fixing the plurality of blades one blade at a time to the circular support plates, so there is the problem that variations in the positional accuracy of the blades occur when each of the blades is fixed to the circular support plates, and rotational strength is low. Further, there is also the problem that the number of manufacturing man-hours increases. Particularly when the impeller is manufactured by a resin, the number of manufacturing man-hours increases even more because it becomes necessary to use a solvent or an adhesive in order to reliably fix each of the blades to the circular support plates, and it is difficult to mass-produce the impeller.

It is an object of the present invention to make an impeller of a multiblade blower having a plurality of blades on whose blade tips are formed serrated shapes into one where there are few variations in the positional accuracy of the blades and where rotational strength is improved, and to reduce the number of manufacturing man-hours.

An impeller of a multiblade blower pertaining to a first aspect of the present invention is disposed with circular support plates that are made of a resin and rotate about an axis of rotation and a plurality of blades that are made of a resin. The blades are disposed on outer peripheral portions of the circular support plates so as to be parallel to the axis of rotation, and serrated shapes are formed on the blades by cutting out blade tips at plural places. A step is formed in a blade face of each of the blades at a position a predetermined distance from the blade tip where the serrated shape is formed.

When an impeller of a multiblade blower is manufactured by a resin, it is desirable to integrally mold by injection molding the circular support plates and the plurality of blades in order for there to be few variations in the positional accuracy of the blades, to improve rotational strength, and to reduce the number of manufacturing man-hours. However, due to restrictions of the molds and the like, it is difficult to form serrated shapes on the blades and injection-mold the blades and the circular support plates such that the blades and the circular support plates become integrated.

Thus, in this impeller of a multiblade blower, a step is formed in the blade face of each of the blades at a position a predetermined distance away from the blades tip where the serrated shape is formed, and injection molding-use molds that form this step are used, whereby it is possible to form the serrated shapes on the blade tips of the blades and mold the blades and the circular support plates such that the blades and the circular support plates become integrated. That is, according to the present invention, an impeller of a multiblade blower having a plurality of blades on whose blade tips are formed serrated shapes can be made into one where there are few variations in the positional accuracy of the blades and where rotational strength is improved, and the number of manufacturing man-hours can be reduced.

An impeller of a multiblade blower pertaining to a second aspect of the present invention comprises the impeller of a multiblade blower pertaining to the first aspect of the present invention, wherein in the blade face of each of the blades, assuming that the blade face leading from the position where the step is formed to the blade tip where the serrated shape is formed is a first blade face and the blade face leading from the position where the step is formed to the opposite side of the blade tip where the serrated shape is formed is a second blade face, then a distance, in a blade thickness direction, between the first blade face and the second blade face at the position where the step is formed is equal to or less than 0.05 mm.

In this impeller of a multiblade blower, the size of the step is equal to or less than 0.05 mm, so turbulence in the airflow resulting from forming the step can be controlled.

An impeller of a multiblade blower pertaining to a third aspect of the present invention comprises the impeller of a multiblade blower pertaining to the first or second aspect of the present invention, wherein in the blade face of each of the blades, assuming that the blade face leading from the position where the step is formed to the blade tip where the serrated shape is formed is a first blade face and the blade face leading from the position where the step is formed to the opposite side of the blade tip where the serrated shape is formed is a second blade face, then the first blade face is recessed in a blade thickness direction with respect to the second blade face at the position where the step is formed.

In this impeller of a multiblade blower, it becomes easier for the airflow flowing over the blade face of each of the blades from the second blade face towards the first blade face to flow more smoothly, so that even when the step is formed in the blade face of each of the blades, the noise reducing effect resulting from the serrated shape can be reliably obtained.

An impeller of a multiblade blower pertaining to a fourth aspect of the present invention comprises the impeller of a multiblade blower pertaining to any of the first to third aspects of the present inventions, wherein the serrated shape is a shape formed by cutting out the blade tip of each of the blades in triangular shapes, and assuming that intersection points hypothetically interconnecting two sides that extend in a blade width direction from the blade tip of each of the blades and form the triangular cutout portions are hypothetical intersection points, then the predetermined distance is a distance from the blade tip where the serrated shape is formed to the hypothetical intersection point.

In this impeller of a multiblade blower, the step is formed in the vicinity of the serrated shape, and generally it becomes easier for the airflow flowing over the blade face of each of the blades to flow more smoothly, so a predetermined wind blowing performance can be reliably obtained.

An impeller of a multiblade blower pertaining to a fifth aspect of the present invention comprises the impeller of a multiblade blower pertaining to any of the first to fourth aspects of the present inventions, wherein the step is formed so as to extend parallel to the blade tip of each of the blades.

In this impeller of a multiblade blower, the step is formed so as to extend parallel to the blade tip of each of the blades, so the shapes of the injection molding-use molds that form the step can be made simple; thus, the work of releasing the impeller that has been molded also becomes easy. Further, the affect on turbulence in the airflow resulting from forming the step extends uniformly with respect to the longitudinal direction of the blade, so it is difficult for local wind blowing performance to become worse and for noise to increase.

An impeller of a multiblade blower pertaining to a sixth aspect of the present invention comprises the impeller of a multiblade blower pertaining to any of the first to fifth aspects of the present inventions, wherein the step is formed just in one blade face of each of the blades.

In this impeller of a multiblade blower, the step is formed just in one blade face of each of the blades, so turbulence in the airflow resulting from forming the step can be controlled.

An impeller of a multiblade blower pertaining to a seventh aspect of the present invention comprises the impeller of a multiblade blower pertaining to any of the first to sixth aspect of the present inventions, wherein the step is formed at a position farther in the blade width direction from the blade tip where the serrated shape is formed than portions of the cutout portions forming the serrated shape of each of the blades that are farthest in the blade width direction from the blade tip where the serrated shape is formed.

In this impeller of a multiblade blower, the step is formed at a position farther in the blade width direction from the blade tip where the serrated shape is formed than portions of the cutout portions forming the serrated shape that are farthest in the blade width direction from the blade tip where the serrated shape is formed, so it becomes difficult for burrs to occur at the portions where the serrated shapes are formed during injection molding.

A method of manufacturing an impeller of a multiblade blower pertaining to an eighth aspect of the present invention is a method of manufacturing an impeller of a multiblade blower disposed with circular support plates that are made of a resin and rotate about an axis of rotation and a plurality of blades that are made of a resin, disposed on outer peripheral portions of the circular support plates so as to be parallel to the axis of rotation, and on which serrated shapes are formed by cutting out blade tips at plural places, the method comprising: a step of forming a cavity into which a resin is injected by axial-direction-removable molds and radial-direction-removable molds; a step of injecting the resin inside the cavity; and a step of removing the radial-direction-removable molds in a direction intersecting the axis-of-rotation direction with respect to the axial-direction-removable molds after the resin has solidified inside the cavity. Here, the axial-direction-removable molds are molds for forming portions of blade faces of the blades excluding portions to positions a predetermined distance from the blade tips where the serrated shapes are formed. The radial-direction-removable molds are molds that are disposed facing the axial-direction-removable molds in a direction intersecting the axis-of-rotation direction and are for forming portions of the blade faces of the blades to positions a predetermined distance from the blade tips where the serrated shapes are formed.

In this method of manufacturing an impeller of a multiblade blower, the axial-direction-removable molds and the radial-direction-removable molds are used to form the serrated shapes on the blade tips of the blades and to perform injection molding such that the blades and the circular support plates become integrated, so in the impeller after molding, a step corresponding to the matching surfaces between the axial-direction-removable molds and the radial-direction-removable molds is formed at a position in the blade face of each of the blades that is a predetermined distance from the blade tip where the serrated shape is formed. That is, in this method of manufacturing an impeller of a multiblade blower, molds are used such that the step is formed at a position in the blade face of each of the blades of the impeller after molding that is a predetermined distance from the blade tip where the serrated shape is formed, whereby the serrated shapes can be formed on the blade tips of the blades, and the blades and the circular support plates can be injection-molded such that the blades and the circular support plates become integrated.

Thus, in this method of manufacturing an impeller of a multiblade blower, an impeller of a multiblade blower having a plurality of blades on whose blade tips are formed serrated shapes can be made into one where there are few variations in the positional accuracy of the blades and where rotational strength is improved, and the number of manufacturing man-hours can be reduced.

A method of manufacturing an impeller of a multiblade blower pertaining to a ninth aspect of the present invention is a method of manufacturing an impeller of a multiblade blower disposed with circular support plates that are made of a resin and rotate about an axis of rotation and a plurality of blades that are made of a resin, disposed on outer peripheral portions of the circular support plates so as to be parallel to the axis of rotation, and on which serrated shapes are formed by cutting out blade tips at plural places, the method comprising: a step of forming a cavity into which a resin is injected by axial-direction-removable molds and a circumferential-direction-removable mold; a step of injecting the resin inside the cavity; and a step of rotating and removing the circumferential-direction-removable mold about the axis of rotation with respect to the axial-direction-removable molds after the resin has solidified inside the cavity. Here, the axial-direction-removable molds are molds for forming portions of blade faces of the blades excluding portions to positions a predetermined distance from the blade tips where the serrated shapes are formed. The circumferential-direction-removable mold is a mold that is disposed so as to be relatively rotatable with respect to the axial-direction-removable molds and is for forming portions of the blade faces of the blades to positions a predetermined distance from the blade tips where the serrated shapes are formed.

In this method of manufacturing an impeller of a multiblade blower, the axial-direction-removable molds and the circumferential-direction-removable mold are used to form the serrated shapes on the blade tips of the blades and to perform injection molding such that the blades and the circular support plates become integrated, so in the impeller after molding, a step corresponding to the matching surfaces between the axial-direction-removable molds and the circumferential-direction-removable mold is formed at a position in the blade face of each of the blades that is a predetermined distance from the blade tip where the serrated shape is formed. That is, in this method of manufacturing an impeller of a multiblade blower, molds are used such that the step is formed at a position in the blade face of each of the blades of the impeller after molding that is a predetermined distance from the blade tip where the serrated shape is formed, whereby the serrated shapes can be formed on the blade tips of the blades, and the blades and the circular support plates can be injection-molded such that the blades and the circular support plates become integrated.

Thus, in this method of manufacturing an impeller of a multiblade blower, an impeller of a multiblade blower having a plurality of blades on whose blade tips are formed serrated shapes can be made into one where there are few variations in the positional accuracy of the blades and where rotational strength is improved, and the number of manufacturing man-hours can be reduced.

DETAILED DESCRIPTION OF THE INVENTION

Below, an embodiment of an impeller of a multiblade blower pertaining to the present invention and a method of manufacturing the same will be described on the basis of the drawings.

(1) Configuration of Air Conditioner

Figure 1:
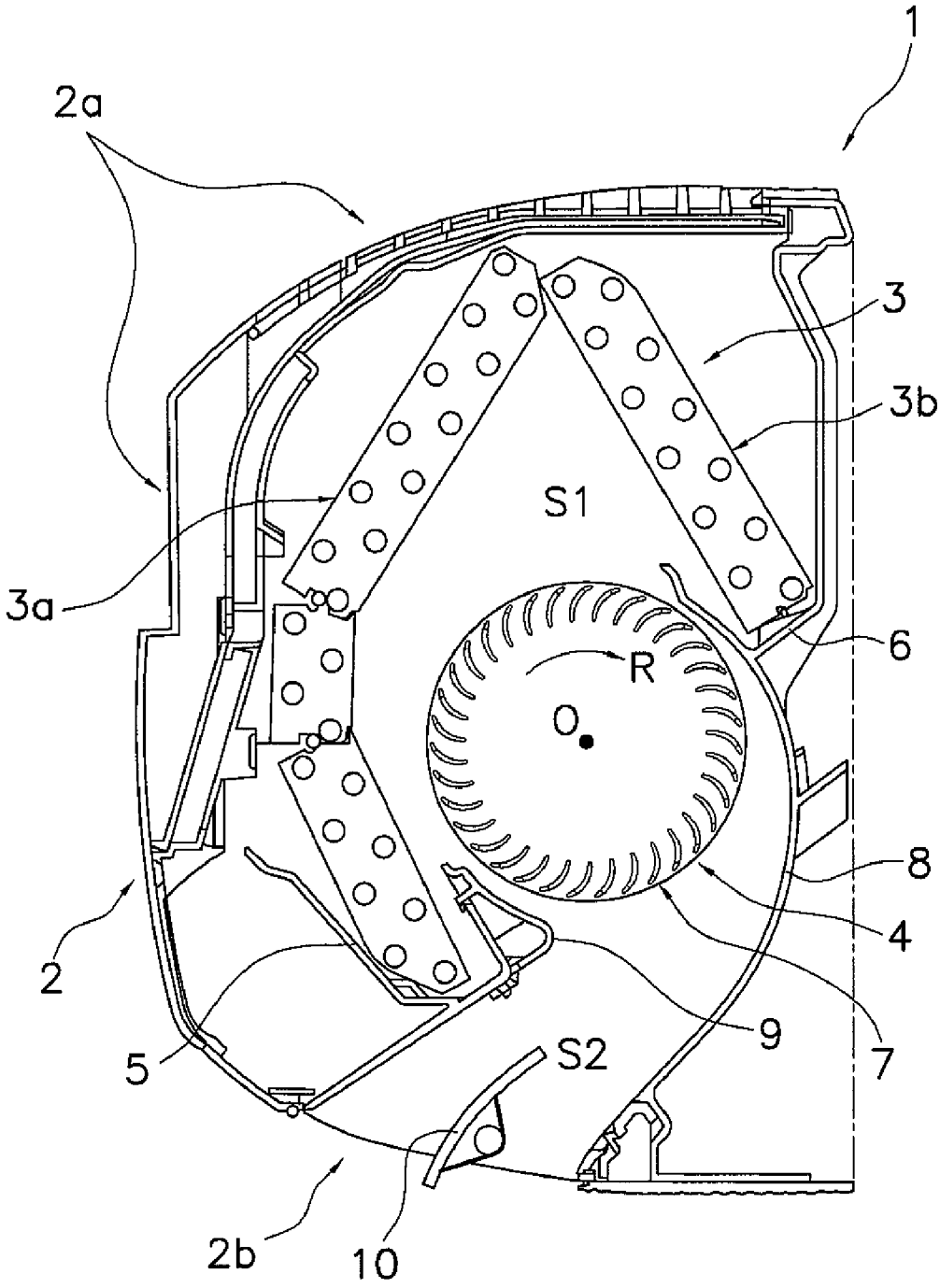
FIG. 1 is a general cross-sectional view of a wall-mounted air conditioner serving as an example of a device in which an impeller of a multiblade blower pertaining to the present invention is used.

First, an air conditioner 1 serving as an example of a device in which the impeller of a multiblade blower pertaining to the present invention is used will be described using FIG. 1. Here, FIG. 1 is a general cross-sectional view of the wall-mounted air conditioner 1 serving as an example of a device in which the impeller of a multiblade blower pertaining to the present invention is used. Further, the left side of the page of FIG. 1 will be referred to as the front side of the air conditioner, and the top side of the page will be referred to as the top side of the air conditioner.

The air conditioner 1 is mainly disposed with a wall-mounted casing 2, a heat exchanger 3 disposed inside the casing 2, and a blower 4.

The casing 2 includes an air suction opening 2*a* disposed in the top surface and the front surface in order to suck air inside the casing 2 and an air blowout opening 2*b* disposed in the front side portion of the bottom surface in order to blow air outside the casing 2. A horizontal blade 10 for adjusting the direction of the airflow blown out from the air blowout opening 2*b* is disposed in the air blowout opening 2*b*.

The heat exchanger 3 mainly includes a front heat exchanger portion 3*a* disposed so as to face the front side of the casing 2 and a rear heat exchanger portion 3*b* disposed so as to face the rear side of the casing 2. The rear heat exchanger portion 3*b* extends diagonally downward from the upper end of the front heat exchanger portion 3*a*. Additionally, drain pans 5 and 6 are disposed below the heat exchanger 3.

The blower 4 is a cross-flow fan that includes a motor (not shown) that serves as a drive mechanism and an impeller 7 that is driven to rotate in the direction of R by the motor, and the blower 4 is disposed such that it can suck air inside the casing 2 from the air suction opening 2*a*, allow the air to be passed through the heat exchanger 3, and thereafter blow the airflow outside the casing 2 from the air blowout opening 2*b*. Specifically, the blower 4 is disposed between the heat exchanger 3 and the air blowout opening 2*b* in relation to the flow direction of the air inside the casing 2. A guide portion 8 that guides, to the air blowout opening 2*b*, the airflow blown out into a space S2 between the impeller 7 and the air blowout opening 2*b* after the airflow flows through the impeller 7 from a space S1 between the heat exchanger 3 and the impeller 7 is disposed on the rear side of the impeller 7, and a tongue portion 9 that prevents the airflow blown out into the space S2 from reversely flowing into the space S1 is disposed on the front side of the impeller 7.

In this manner, in the air conditioner 1, the impeller 7 of the blower 4 is driven to rotate, whereby a flow can be generated where air inside the casing 2 flows through the impeller 7 so as to be orthogonal with respect to an axis-of-rotation line O of the impeller 7 and is blown out from the air blowout opening 2*b*—that is, an airflow leading from the space S1 to the space S2. Thus, in this air conditioner 1, air is sucked inside the casing 2 from the air suction opening 2*a*, and the airflow that has been sucked inside the casing 2 passes through the heat exchanger 3, whereby cooling or heating is performed, and the airflow is blown outside the casing 2 from the air blowout opening 2*b* via the impeller 7 of the blower 4.

(2) Configuration of Impeller

Figure 2:
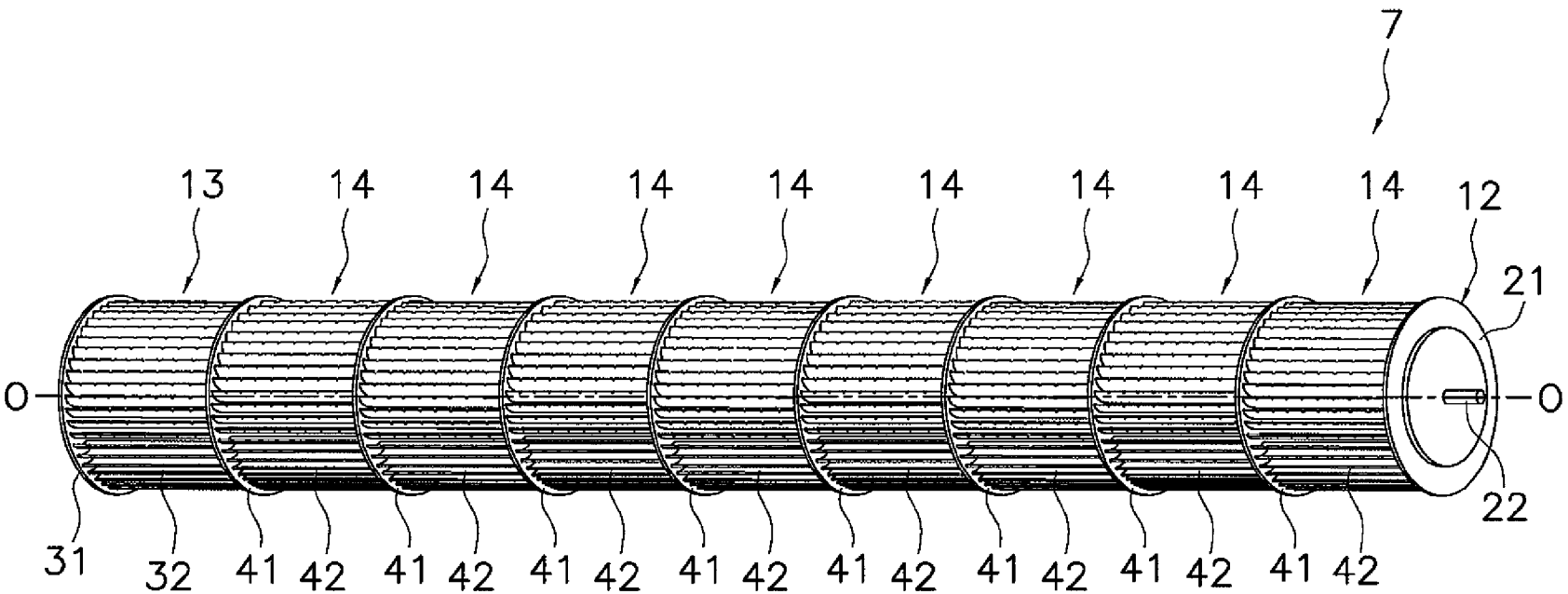
FIG. 2 is an external perspective view showing an impeller of a blower serving as an impeller of a multiblade blower pertaining to the present invention.
Figure 3:
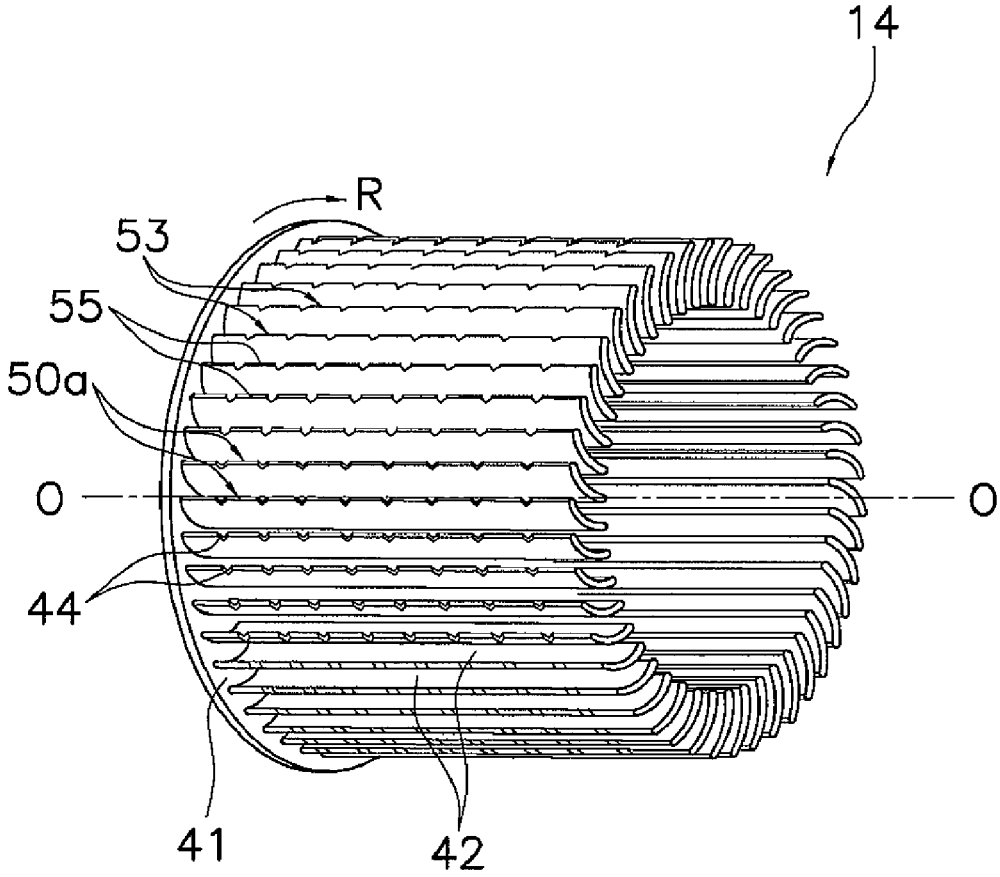
FIG. 3 is a perspective view showing one of second impeller-configuring bodies that configure the impeller.
Figure 4:
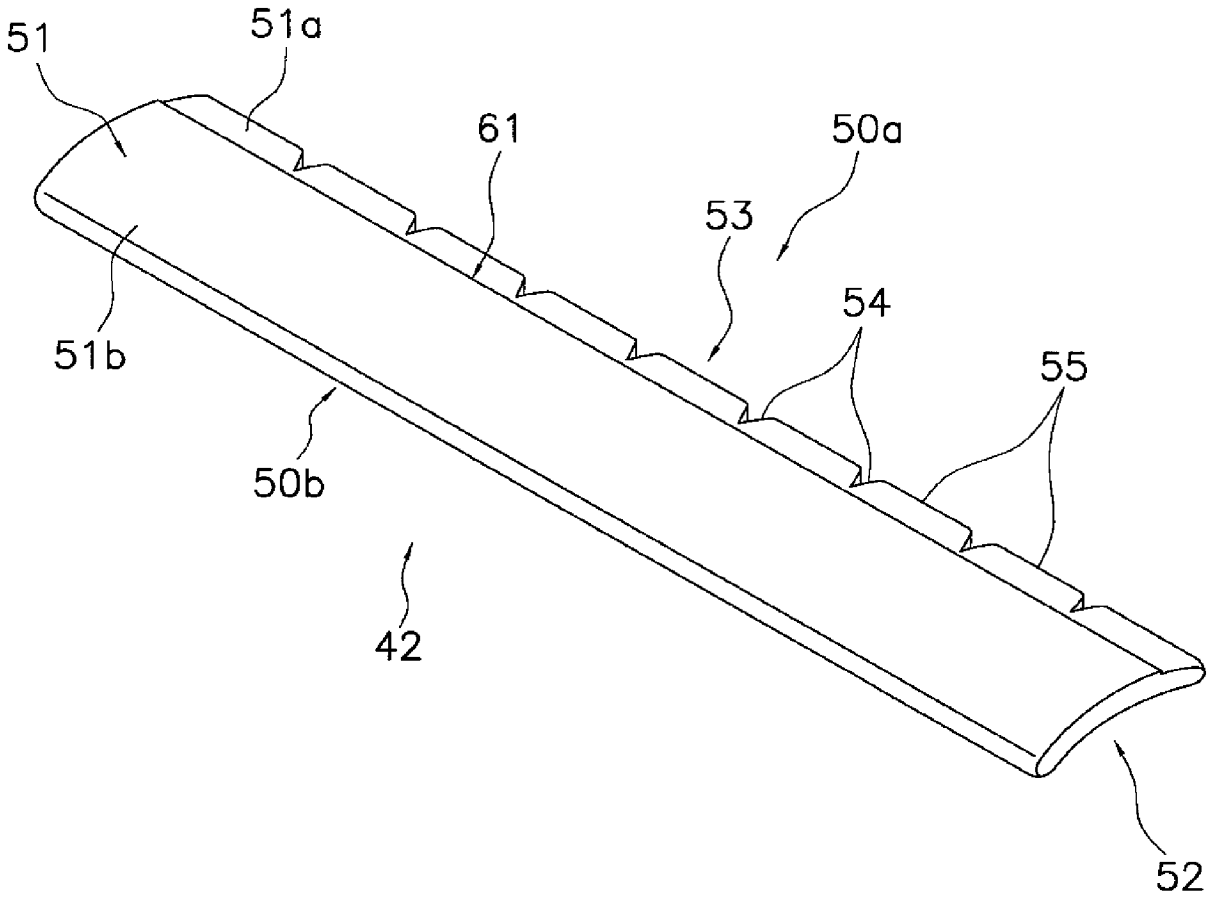
FIG. 4 is an enlarged perspective view showing one of blades.
Figure 5:
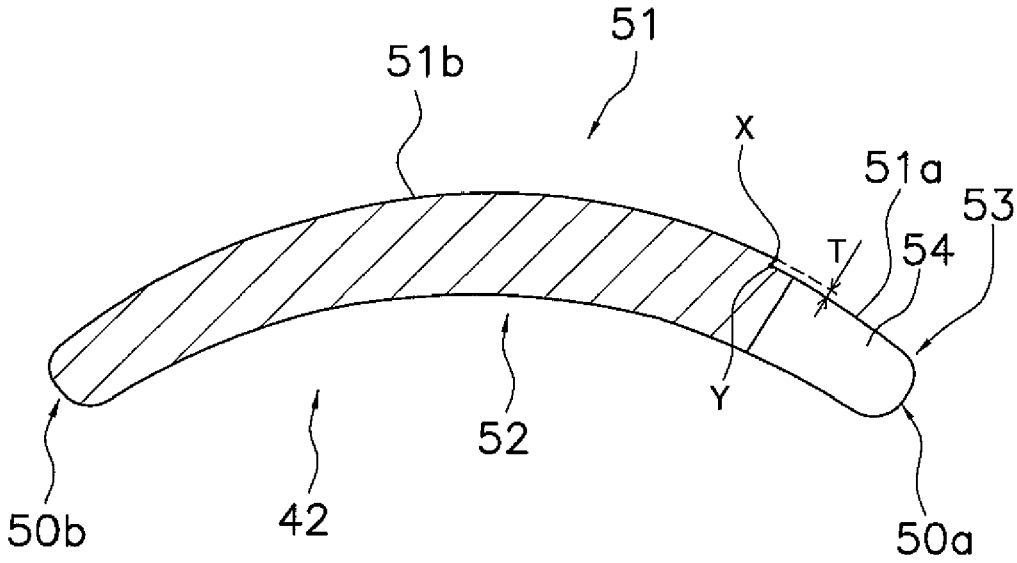
FIG. 5 is a cross-sectional view of the blade.
Figure 6:
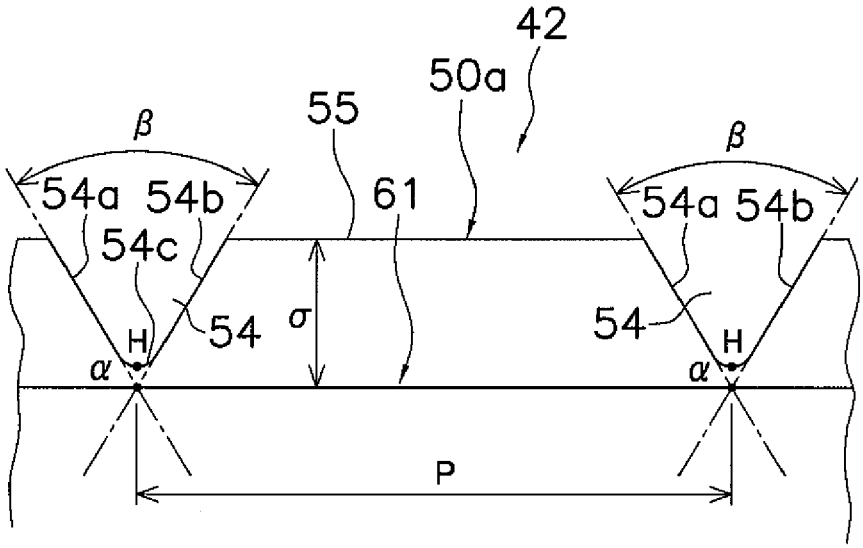
FIG. 6 is an enlarged view showing part of a blade tip of the blade.

Next, the impeller 7 of the blower 4 serving as the impeller of a multiblade blower pertaining to the present invention will be described using FIG. 2 to FIG. 6. Here, FIG. 2 is an external perspective view showing the impeller 7 of the blower 4 serving as the impeller of a multiblade blower pertaining to the present invention. FIG. 3 is a perspective view showing one of second impeller-configuring bodies 14 that configure the impeller 7. FIG. 4 is an enlarged perspective view showing one of blades 42. FIG. 5 is a cross-sectional view of the blade 42. FIG. 6 is an enlarged view showing part of a blade tip of the blade 42. In the following description, "axis-of-rotation direction" will refer to the direction of the axis-of-rotation line O of the impeller 7.

The impeller 7 has a rotor-like external shape that is long and narrow in the axis-of-rotation direction. The impeller 7 mainly includes a circular end face plate 12 that configures one end of the impeller 7 in the axis-of-rotation direction, a first impeller-configuring body 13 that configures the other end of the impeller 7 in the axis-of-rotation direction, and one or more (here, eight) second impeller-configuring bodies 14 disposed between the circular end face plate 12 and the first impeller-configuring body 13 in the circumferential direction, and the impeller 7 has a structure where these configural members are joined together.

The circular end face plate 12 mainly includes a disc-shaped circular support plate 21 that is made of a resin and rotates about the axis of rotation (that is, the axis-of-rotation line O) of the impeller 7. Further, a shaft portion 22 serving as a rotating shaft of the impeller 7 is disposed in the center of the circular support plate 21.

Each of the second impeller-configuring bodies 14 includes a disc-shaped circular support plate 41 that is made of a resin and rotates about the axis of rotation (that is, the axis-of-rotation line O) of the impeller 7 and a plurality of blades 42 that are disposed side-by-side in the circumferential direction on an outer peripheral portion of the circular support plate 41 so as to be parallel to the axis of rotation of the impeller 7, and the circular support plate 41 and the plural blades 42 are integrally molded by injection molding. Further, a center hole (not shown) is disposed in the center of each of the circular support plates 41 so as to be surrounded by the plural blades 42.

Each of the blades 42 has a slanted blade structure (here, a forwardly slanted blade structure) where the blade is disposed so as to slant a predetermined blade angle towards one side in the direction of rotation of the impeller 7 (here, forward in the direction of rotation; that is, the R direction).

Further, a serrated shape 53 is formed on each of the blades 42 by cutting out the blade tip (here, an outer peripheral blade tip 50*a*) at plural places. More specifically, each of the serrated shapes 53 is configured by plural cutout portions 54 that are triangular and formed at predetermined intervals (that is, a pitch P) in the longitudinal direction of the blade 42 and by smooth portions 55 that are disposed between the cutout portions 54 and configure part of the blade tip (here, the outer peripheral blade tip 50*a*) of the blade 42. Here, when each of the blades 42 is seen in a plan view, two sides 54*a* and 54*b* that form each of the cutout portions 54 extend in a blade width direction (here, towards the inner peripheral side) from the blade tip (here, the outer peripheral blade tip 50*a*) of the blade 42 so as to form an angle β. Further, when each of the blades 42 is seen in a plan view, a portion (here, a side 54*c*) of each of the cutout portions 54 that is farthest in the blade width direction (here, towards the inner peripheral side) from the blade tip (here, the outer peripheral blade tip 50*a*) of the blade 42 has a curved shape so as to smoothly interconnect the inner peripheral ends of the two sides 54*a* and 54*b*. For this reason, when each of the blades 42 is seen in a plan view, an endpoint H of the portion (here, the side 54*c*) of each of the cutout portions 54 that is farthest in the blade width direction (here, towards the inner peripheral side) from the blade tip (here, the outer peripheral blade tip 50*a*) of the blade 42 is positioned in a position closer to the blade tip (here, the outer peripheral blade tip 50*a*) of the blade 42 than a hypothetical intersection point a where the inner peripheral end portions of the two sides 54*a* and 54*b* would intersect if they were to be hypothetically extended towards the inner peripheral side. In other words, when each of the blades 42 is seen in a plan view, each of the cutout portions 54 does not have a triangular shape where the portion of each of the cutout portions 54 that is farthest in the blade width direction (here, towards the inner peripheral side) from the blade tip (here, the outer peripheral blade tip 50*a*) of the blade 42 is sharply pointed but rather has a triangular shape where the portion of each of the cutout portions 54 that is farthest in the blade width direction (here, towards the inner peripheral side) from the blade tip (here, the outer peripheral blade tip 50*a*) of the blade 42 is rounded.

Moreover, a step 61 is formed in a blade face of each of the blades 42 at a position a predetermined distance (that is, a distance σ) from the blade tip (here, the outer peripheral blade tip 50*a*) where the serrated shape 53 is formed. More specifically, the step 61 is formed in a rear blade face 51 that configures the rear side of each of the blades 42 in the direction of rotation. That is, the step 61 is formed just in one blade face of each of the blades 42. Here, in the blade face (here, the rear blade face 51) of each of the blades 42, assuming that the blade face leading from the position where the step 61 is formed to the blade tip (here, the outer peripheral blade tip 50*a*) where the serrated shape 53 is formed is a first blade face 51*a* and the blade face leading from the position where the step 61 is formed to the opposite side (here, the inner peripheral side) of the blade tip (here, the outer peripheral blade tip 50*a*) where the serrated shape 53 is formed is a second blade face 51*b*, then a distance T, in a blade thickness direction, between the first blade face 51*a* and the second blade face 51*b* at the position where the step 61 is formed is equal to or less than 0.05 mm. Further, the first blade face 51*a* is recessed in the blade thickness direction with respect to the second blade face 51*b*. Further, the step 61 is formed such that the first blade face 51*a* and the second blade face 51*b* are discontinuous. That is, when each of the blades 42 is seen in a cross-sectional view, an endpoint X of the second blade face 51*b* on the side of the first blade face 51*a* and an endpoint Y of the first blade face 51*a* on the side of the second blade face 51*b* are separated from each other in the blade thickness direction. Further, when each of the blades 42 is seen in a cross-sectional view, a hypothetical blade face (see the one-dotted chain line extending from endpoint X in FIG. 5) formed if the second blade face 51*b* were to smoothly extend towards the first blade face 51*a* is substantially parallel to the first blade face 51*a* in the vicinity of the step 61. Further, when each of the blades 42 is seen in a plan view, the step 61 is formed so as to pass over the hypothetical intersection points α. That is, the distance σ becomes the distance from the blade tip (here, the outer peripheral blade tip 50*a*) where the serrated shape 53 is formed to the hypothetical intersection points α. For this reason, when each of the blades 42 is seen in a plan view, the step 61 is formed in a position that is farther in the blade width direction from the blade tip (here, the outer peripheral blade tip 50*a*) where the serrated shape 53 is formed than the portions (here, the endpoints H of the sides 54*c*) of the cutout portions 54 forming the serrated shape 53 of each of the blades 42 that are farthest in the blade width direction from the blade tip (here, the outer peripheral blade tip 50*a*) where the serrated shape 53 is formed. Further, the step 61 is formed so as to extend parallel to the blade tip (here, the outer peripheral blade tip 50*a*) of each of the blades 42. It will be noted that, here, because the cutout portions 54 formed in each of the blades 42 have the same size, when each of the blades 42 is seen in a plan view, the step 61 is formed on a line interconnecting the plural hypothetical intersection points α corresponding to the cutout portions 54.

The first impeller-configuring body 13 includes a disc-shaped circular support plate 31 that is made of a resin and rotates about the axis of rotation (that is, the axis-of-rotation line O) of the impeller 7 and a plurality of blades 32 that are made of a resin and disposed side-by-side in the circumferential direction on an outer peripheral portion of the circular support plate 31 so as to be parallel to the axis of rotation of the impeller 7, and the circular support plate 31 and the plural blades 32 are integrally molded by injection molding. Further, a shaft portion (not shown) serving as a rotating shaft of the impeller 7 is disposed in the center of the circular support plate 31. The first impeller-configuring body 13 is different from the second impeller-configuring bodies 14 in that a shaft portion is disposed in the center of the circular support plate 31 configuring the first impeller-configuring body 13, but each of the plural blades 32 that configure the first impeller-configuring body 13 has, similar to each of the plural blades 42 that configure the second impeller-configuring bodies 14, a structure including the serrated shape 53 and the step 61, so description thereof will be omitted here.

(3) Characteristics of Impeller in Terms of its Running Operation

The impeller 7 of the blower 4 serving as the impeller of a multiblade blower pertaining to the present invention has the following characteristics in terms of its running operation.

(A)

In the impeller 7 of the present embodiment, the serrated shape 53 is formed on the outer peripheral blade tip 50*a* of each of the blades 32 and 42, so when air is sucked inside the impeller 7 from the space S1 (see FIG. 1), separation of the airflow at the blade faces (particularly the blade faces 51) of the blades 32 and 42 can be controlled by vertical vortexes formed at the cutout portions 54 that configure the serrated shapes 53, and noise can be reduced. Further, when air is blown out into the space S2 from the inside of the impeller 7 (see FIG. 1), horizontal vortexes whose scale is large and which are discharged from the outer peripheral blade tips 50*a* of the blades 32 and 42 become broken down into organized, stable horizontal vortexes whose scale is small by the vertical vortexes formed at the cutout portions 54, and noise can be reduced.

(B)

In the impeller 7 of the present embodiment, the step 61 is formed in the blade face (here, the rear blade face 51) of each of the blades 32 and 42 at a position a predetermined distance (here, the distance σ) from the blade tip (here, the outer peripheral blade tip 50*a*) where the serrated shape 53 is formed, so that, as will be described later, the first impeller-configuring body 13 configured by the circular support plate 31 and the plural blades 32 where the serrated shapes 53 are formed and the second impeller-configuring bodies 14 configured by the circular support plates 41 and the plural blades 42 where the serrated shapes 53 are formed can be integrally molded by injection molding. For this reason, there is the potential for it to become easier for turbulence to arise in the airflow flowing over the blade face (here, the rear blade face 51) of each of the blades 32 and 42. However, in the impeller 7 of the present embodiment, the size of the step 61 (that is, the distance T) is equal to or less than 0.05 mm, so turbulence in the airflow resulting from forming the step 61 can be controlled.

(C)

In the impeller 7 of the present embodiment, the first blade face 51*a* is recessed in the blade thickness direction with respect to the second blade face 51*b*, so it becomes easier for the airflow flowing over the blade face of each of the blades 32 and 42 from the second blade face 51*b* towards the first blade face 51*a* to flow more smoothly, so that even when the step 61 is formed in the blade face (here, the rear blade face 51) of each of the blades 32 and 42, the noise reducing effect resulting from the serrated shape 53 can be reliably obtained.

(D)

In the impeller 7 of the present embodiment, the distance σ is the distance from the blade tip (here, the outer peripheral blade tip 50*a*) where the serrated shape 53 is formed to the hypothetical intersection points α, and the step 61 is formed in the vicinity of the serrated shape 53, so generally it becomes easier for the airflow flowing over the blade face (here, the rear blade face 51) of each of the blades 32 and 42 to flow more smoothly, and a predetermined wind blowing performance can be reliably obtained.

(E)

In the impeller 7 of the present embodiment, the step 61 is formed so as to extend parallel to the blade tip (here, the outer peripheral blade tip 50*a*) of each of the blades 32 and 42, so the affect on turbulence in the airflow resulting from forming the step 61 extends uniformly with respect to the longitudinal direction of the blades 32 and 42, and it becomes difficult for local wind blowing performance to become worse and for noise to increase.

(F)

In the impeller 7 of the present embodiment, the step 61 is formed just in one blade face (here, the rear blade face 51) of each of the blades 32 and 42, so turbulence in the airflow resulting from forming the step 61 can be controlled.

(4) Method of Manufacturing Impeller

Figure 7:
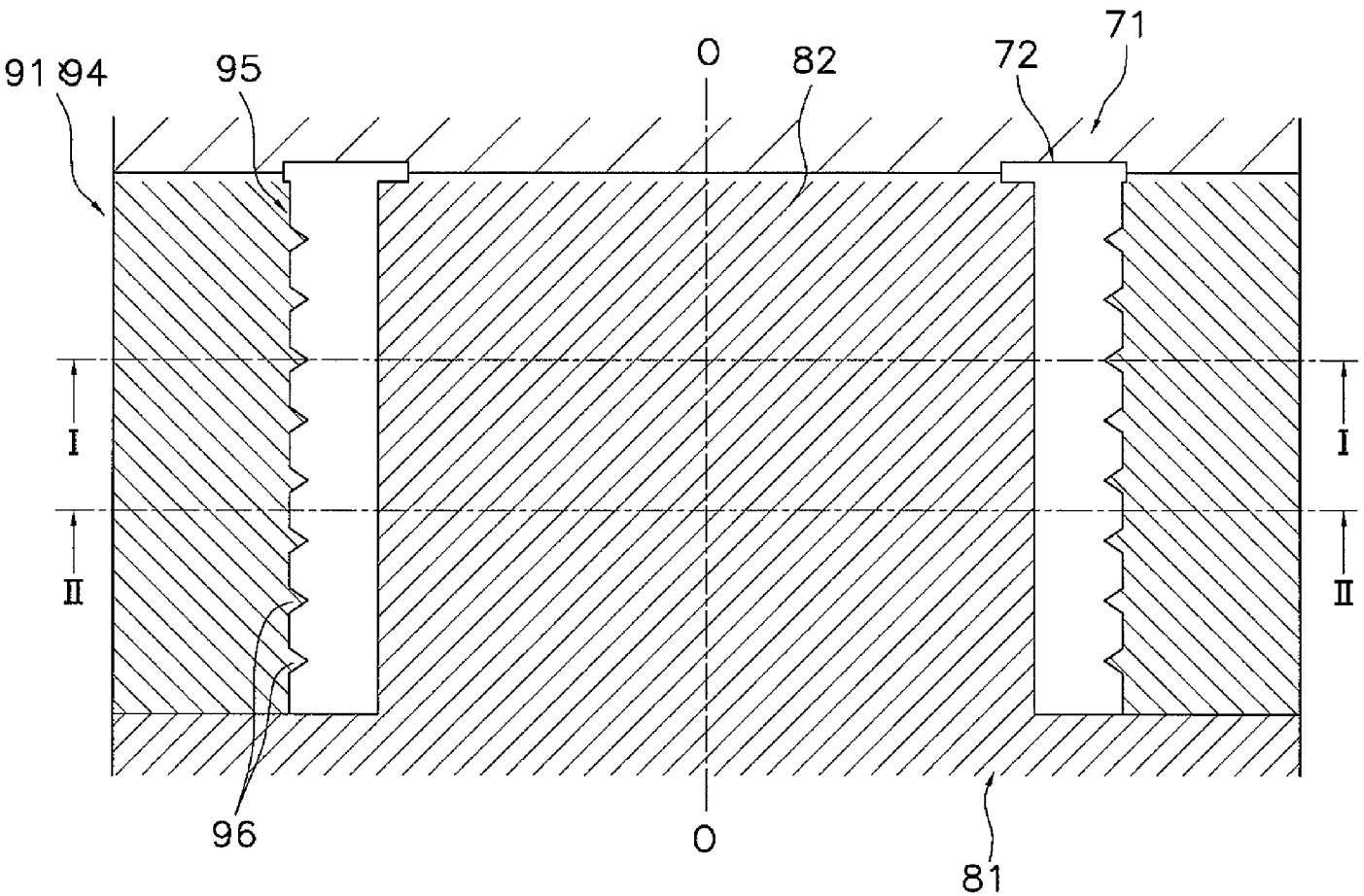
FIG. 7 is a general side sectional view showing molds for injection-molding the second impeller-configuring bodies that configure the impeller.
Figure 8:
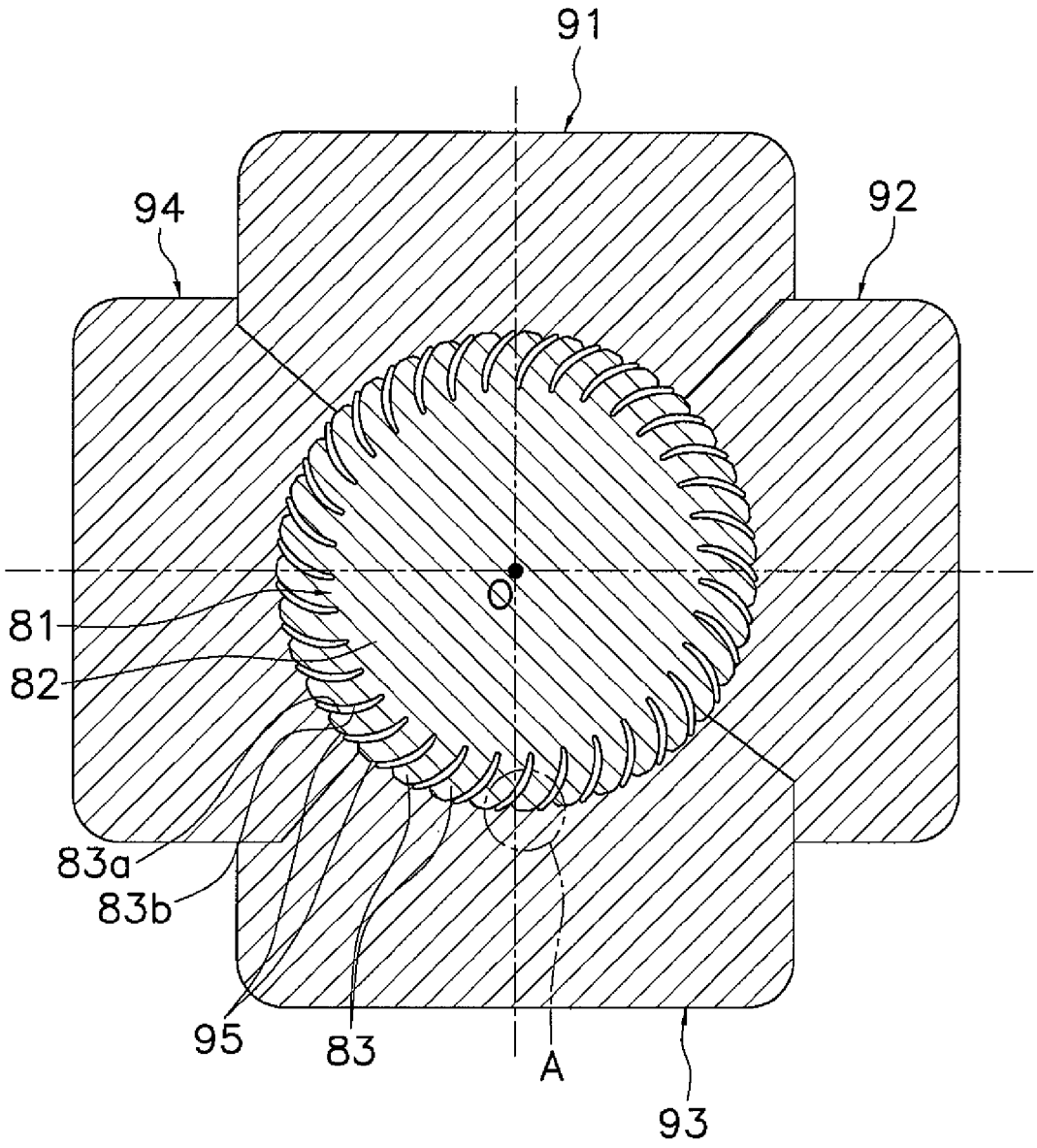
FIG. 8 is a general plan sectional view (with the left half showing a cross section along I-I of FIG. 7 and the right half showing a cross section along II-II of FIG. 7) showing the molds for injection-molding the second impeller-configuring bodies that configure the impeller.
Figure 9:
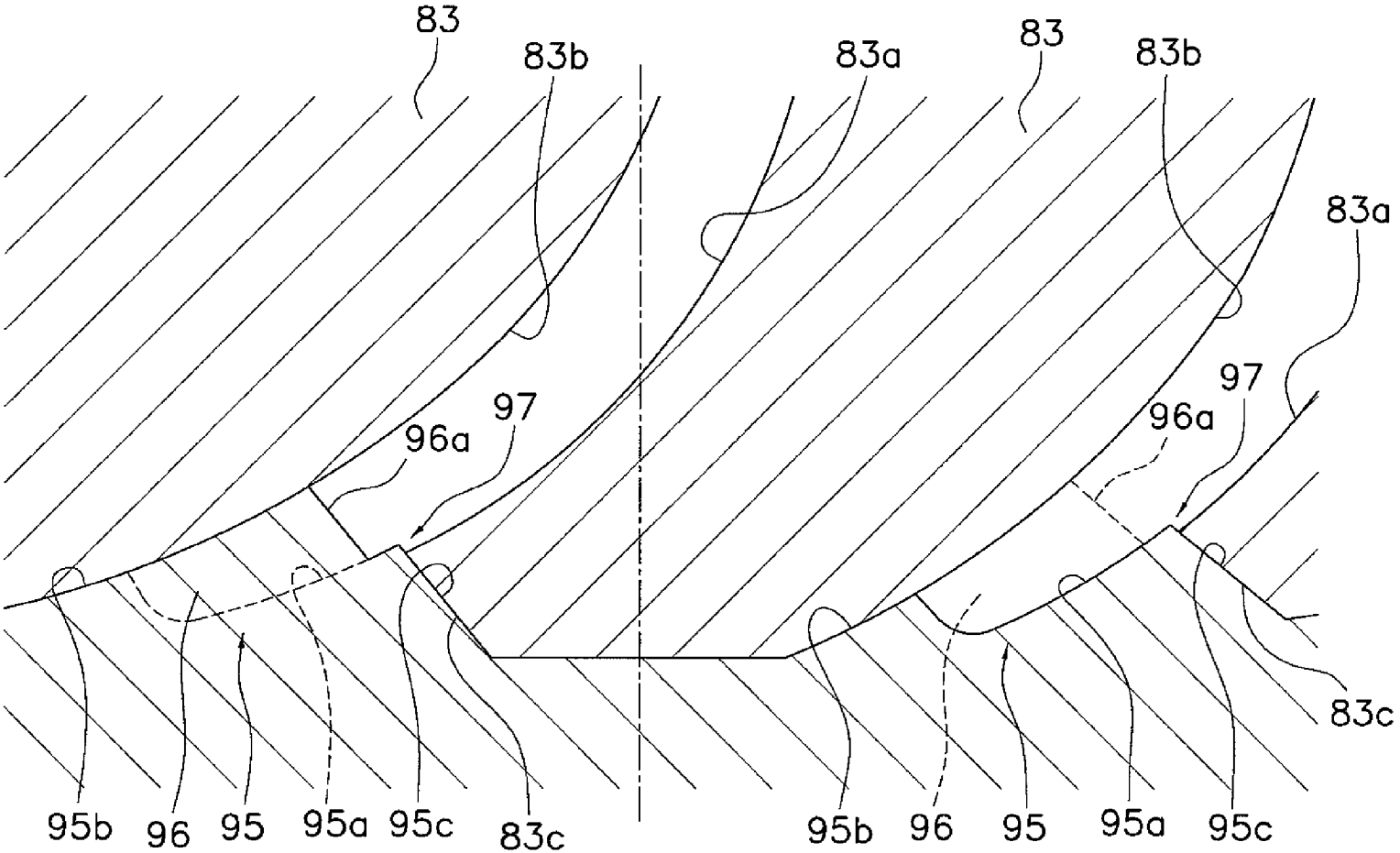
FIG. 9 is an enlarged view showing portion A of FIG. 8.

Next, a method of manufacturing the impeller 7 of the blower 4 serving as the impeller of a multiblade blower pertaining to the present invention will be described using FIG. 7 to FIG. 9. Here, FIG. 7 is a general side sectional view showing molds for injection-molding the second impeller-configuring bodies 14 that configure the impeller 7. FIG. 8 is a general plan sectional view (with the left half showing a cross section along I-I of FIG. 7 and the right half showing a cross section along II-II of FIG. 7) showing the molds for injection-molding the second impeller-configuring bodies 14 that configure the impeller 7. FIG. 9 is an enlarged view showing portion A of FIG. 8.

The method of manufacturing the impeller 7 is mainly configured by a preparation step, a joining step, and an adjustment step.

The preparation step is a step of preparing the first impeller-configuring body 13 and the second impeller-configuring bodies 14. Specifically, the circular end face plate 12, the first impeller-configuring body 13 and the second impeller-configuring bodies 14 are all obtained by injection-molding them with molds.

Here, injection molding of the first impeller-configuring body 13 and the second impeller-configuring bodies 14 will be described in detail using the second impeller-configuring bodies 14 as an example.

The method of injection-molding the second impeller-configuring bodies 14 uses a pair of axial-direction-removable molds 71 and 81 and radial-direction-removable molds 91 to 94 to integrally injection-mold the circular support plate 41 and the plural blades 42 on whose blade tips the serrated shapes 53 are formed, and is disposed with a step of forming a cavity into which a resin is injected by the pair of axial-direction-removable molds 71 and 81 and the radial-direction-removable molds 91 to 94, a step of injecting the resin inside the cavity, and a step of removing the radial-direction-removable molds 91 to 94 in a direction intersecting the axis-of-rotation direction with respect to the pair of axial-direction-removable molds 71 and 81 after the resin has solidified inside the cavity.

Here, the pair of axial-direction-removable molds 71 and 81 and the radial-direction-removable molds 91 to 94 will be described.

The first axial-direction-removable mold 71 that is one of the pair of axial-direction-removable molds 71 and 81 includes a plate forming portion 72 that is annularly recessed about the axis-of-rotation line O. The plate forming portion 72 is mainly a portion for forming the circular support plate 41. The second axial-direction-removable mold 81 that is the other of the pair of axial-direction-removable molds 71 and 81 is disposed so as to face the first axial-direction-removable mold 71 in the axis-of-rotation direction, and is a mold that can be removed in the axis-of-rotation direction with respect to the first axial-direction-removable mold 71 after the resin has solidified.

The second axial-direction-removable mold 81 includes an axial-direction projecting portion 82 that projects in a circular column shape towards the first axial-direction-removable mold 71 about the axis-of-rotation line O. The axial-direction projecting portion 82 is mainly a portion for forming the inner peripheral portion of the circular support plate 41. It will be noted that the axial-direction projecting portion 82 may also have a circular cylinder shape.

Further, plural radial-direction projecting portions 83 that project from the outer peripheral edge of the axial-direction projecting portion 82 towards the outer peripheral side while slanting in the circumferential direction towards the outer peripheral side are formed in the second axial-direction-removable mold 81. Each of the radial-direction projecting portions 83 is formed so as to extend uniformly from one end of the radial-direction projecting portion 82 to the other end in the axis-of-rotation direction. The radial-direction projecting portions 83 are disposed side-by-side in the circumferential direction, and a cavity for forming part of the blades 42 including inner peripheral blade tips 50*b* (see FIGS. 4 and 5) is formed between the radial-direction projecting portions 83 that are mutually adjacent in the circumferential direction. More specifically, each of the radial-direction projecting portions 83 includes a second rear blade face forming surface 83*a* that forms the second blade face 51*b* (see FIGS. 4 and 5) that is part of the rear blade face 51 of each of the blades 42, a front blade face forming surface 83*b* whose inner peripheral end is connected to the inner peripheral end of the second rear blade face forming surface 83*a* and which forms the front blade face 52 (see FIGS. 4 and 5) of each of the blades 42, and a second matching surface 83*c* that is connected, so as to be substantially orthogonal when seen in a plan view, with respect to the second rear blade face forming surface 83*a* from the outer peripheral end of the second rear blade face forming surface 83*a*. In this manner, the radial-direction projecting portions 83 are mainly portions for forming the outer peripheral portion of the circular support plate 41 (specifically, the portions between the blades 42 in the circumferential direction) and the portion of the blade face of each of the blades 42 excluding the portion to a position a predetermined distance (here, the distance σ) from the blade tip (here, the outer peripheral blade tip 50*a*) where the serrated shape 53 is formed.

The radial-direction-removable molds 91 to 94 are plural (here, four) block-like portions disposed so as to face the axial-direction-removable molds 71 and 81 in a direction intersecting the axis-of-rotation direction, and are molds that can be removed in a direction (here, towards the outer peripheral side) intersecting the axis-of-rotation direction with respect to the axial-direction-removable molds 71 and 81 (here, the second axial-direction-removable mold 81) after the resin has solidified.

Plural blade tip forming portions 95 that project towards the inner peripheral side so as to correspond to the cavity formed by the radial-direction projecting portions 83 of the second axial-direction-removable mold 81 are formed on the inner peripheral edge of each of the radial-direction-removable molds 91 to 94. Each of the blade tip forming portions 95 is formed so as to extend uniformly from one end of the radial-direction projecting portions 83 of the second axial-direction-removable mold 81 in the axis-of-rotation direction towards the other end. Each of the blade tip forming portions 95 includes a first rear blade face forming surface 95*a* that forms the first blade face 51*a* (see FIGS. 4 and 5) that is part of the rear blade face 51 of each of the blades 42, an adhesive surface 95*b* that adheres to the front blade face forming surface 83*b*, and a first matching surface 95*c* that is connected, so as to be substantially orthogonal when seen in a plan view, with respect to the first rear blade face forming surface 95*a* from the inner peripheral end of the first rear blade face forming surface 95*a*. In this manner, the blade tip forming portions 95 are mainly portions for forming the outer peripheral portion of the circular support plate 41 (specifically, the portion further on the outer peripheral side than the outer peripheral ends of the blades 42) and the portion (excluding the cutout portions 54) of the blade face of each of the blades 42 to a position a predetermined distance (here, the distance σ) from the blade tip (here, the outer peripheral blade tip 50*a*) where the serrated shape 53 is formed.

Further, plural serration forming portions 96 for forming the cutout portions (see FIGS. 4 to 6) of the serrated shapes 53 of the blade tips (here, the outer peripheral blade tips 50*a*) of the blades 42 are formed on each of the blade tip forming portions 95. Each of the serration forming portions 96 is a portion that protrudes towards the inner peripheral side along the front blade face forming surface 83*b* of the second axial-direction-removable mold 81 and the first rear blade face forming surface 95*a* from a position on the first rear blade face forming surface 95*a* corresponding to the blade tip (here, the outer peripheral blade tip 50*a*) of the blade 42 at a predetermined interval (that is, the pitch P of the cutout portions 54) in the axis-of-rotation direction in order to form the cutout portions 54 that configure the serrated shapes 53 of the blades 42, and has the same triangular shape as that of the cutout portions 54 when the radial-direction-removable molds 91 to 94 are seen in a cross-sectional view (see FIGS. 4 to 6). That is, a triangular end surface 96*a* of each of the serration forming portions 96 when the radial-direction-removable molds 91 to 94 are seen in a cross-sectional view has a rounded shape similar to the sides 54*c* of the blades 42. In this manner, the serration forming portions 96 are mainly portions for forming the cutout portions 54 that configure the serrated shapes 53.

That is, when the radial-direction-removable molds 91 to 94 are disposed facing the axial-direction-removable molds 71 and 81 in a direction intersecting the axis-of-rotation direction, the adhesive surfaces 95*b* adhere to the front blade face forming surfaces 83*b*, the first matching surfaces 95*c* adhere to the second matching surfaces 83*c*, and a cavity for forming the blades 42 on whose blade tips (here, the outer peripheral blade tips 50*a*) are formed the serrated shapes 53 is formed. Here, the first blade faces 51*a* that configure the rear blade faces 51 of the blades 42 are formed by the radial-direction-removable molds 91 to 94, and the second blade faces 51*b* that configure the rear blade faces 51 of the blades 42 are formed by the second axial-direction-removable mold 81, so steps 97 corresponding to the matching surfaces (specifically, the first matching surfaces 95*c* and the second matching surfaces 83*c* that face each other in the radial direction) between the second axial-direction-removable mold 81 and the radial-direction-removable molds 91 to 94 are formed. The steps 97 correspond to the steps 61 (see FIGS. 4 and 5) of the blades 42, and the second axial-direction-removable mold 81 and the radial-direction-removable molds 91 to 94 are manufactured such that the distance, in the blade thickness direction, between the first rear blade face forming surfaces 95*a* that form the first blade faces 51*a* and the second rear blade face forming surfaces 83*a* that form the second blade faces 51*b* falls within the distance T (see FIG. 5). Further, the second axial-direction-removable mold 81 and the radial-direction-removable molds 91 to 94 are manufactured such that the first rear blade face forming surfaces 95*a* are recessed towards the front blade face forming surfaces 83*b* with respect to the second blade face forming surfaces 83*a*. Moreover, the second axial-direction-removable mold 81 and the radial-direction-removable molds 91 to 94 are manufactured such that, similar to the relationship between the hypothetical intersection points α and the endpoints H of the edges 54*c* in the blades 42, the steps 97 are formed at positions (here, the inner peripheral sides) farther in the blade width direction from the blade tips (here, the outer peripheral blade tips 50*a*) of the blades 42 than the end surfaces 96*a* of the serration forming portions 96.

Using the axial-direction-removable molds 71 and 81 and the radial-direction-removable molds 91 to 94, first, the radial-direction-removable molds 91 to 94 are disposed so as to face a direction intersecting the axis-of-rotation direction of the second axial-direction-removable mold 81 (here, on the outer peripheral side of the second axial-direction-removable mold 81), and the first axial-direction-removable mold 71 and the second axial-direction-removable mold 81 are put together in the axis-of-rotation direction, whereby a cavity is formed where the circular support plate 41 and the plural blades 42 are integrated. At this time, as mentioned above, the steps 97 are formed between the first rear blade face forming surfaces 95*a* and the second rear blade face forming surfaces 83*a*.

Next, a resin is injected from a gate or the like (not shown) into the cavity formed by the axial-direction-removable molds 71 and 81 and the radial-direction-removable molds 91 to 94, and the resin is allowed to solidify inside the cavity.

Then, the radial-direction-removable molds 91 to 94 are removed in a direction (here, towards the outer peripheral side) intersecting the axis-of-rotation direction with respect to the second axial-direction-removable mold 81, and the first axial-direction-removable mold 71 and the second axial-direction-removable mold 81 are released in the axis-of-rotation direction, whereby the second impeller-configuring body 14 is released.

In this manner, the circular support plate 41 and the plural blades 42 on whose blade tips are formed the serrated shapes 53 can be integrally injection-molded.

Further, in regard to the first impeller-configuring body 13, the shape of the circular support plate 31 is different from the shape of the circular support plates 41 of the second impeller-configuring bodies 14, so the shapes of the axial-direction-removable molds 71 and 81 are slightly different. However, because the shape of the blades 32 is the same as that of the blades 42 of the second impeller-configuring bodies 14 and the shape of the radial-direction-removable molds 91 to 94 and the relationship between the radial-direction-removable molds 91 to 94 and the axial-direction-removable molds 71 and 81 are the same, the circular support plate 31 and the plural blades 32 on whose blade tips are formed the serrated shapes 53 can, similar to the second impeller-configuring bodies 14, be integrally injection-molded.

The joining step is a step of obtaining the impeller 7 by arranging, in the axis-of-rotation direction as shown in FIG. 2, the circular end face plate 12, the first impeller-configuring body 13 and the second impeller-configuring bodies 14 obtained in the preparation step and joining them together by ultrasonic welding or the like.

The adjustment step is a step of actually rotating the impeller 7 obtained in the joining step, inspecting and adjusting fluctuations in the axial center and rotational balance, and obtaining the impeller 7 as a final product.

(5) Characteristics of Method of Manufacturing Impeller of Blower

The method of manufacturing the impeller 7 of the blower 4 serving as the impeller of a multiblade blower pertaining to the present invention has the following characteristics.

(A)

In the method of manufacturing the impeller 7 of the present embodiment, the axial-direction-removable molds 71 and 81 for forming the portion (that is, the second blade face 51*b*) of the blade face of each of the blades 32 and 42 excluding the portion to a position a predetermined distance (here, the distance σ) from the blade tip where the serrated shape 53 is formed and the radial-direction-removable molds 91 to 94 that are disposed facing the axial-direction-removable molds 71 and 81 in a direction intersecting the axis-of-rotation direction and are for forming the portion (that is, the first blade face 51*a*) of the blade face of each of the blades 32 and 42 to a position a predetermined distance (here, the distance σ) from the blade tip (here, the outer peripheral blade tip 50*a*) where the serrated shapes 53 is formed are used to form the serrated shape 53 on the blade tip (here, the outer peripheral blade tip 50*a*) of each of the blades 32 and 42 and to perform injection molding such that the blades 32 and 42 and the circular support plates 31 and 41 become integrated, so in the impeller after molding, the step 61 that corresponds to the matching surfaces (specifically, the first matching surface 95*c* and the second matching surface 83*c* that faces each other in the radial direction) between the axial-direction-removable molds 71 and 81 and the radial-direction-removable molds 91 to 94 is formed at a position in the blade face of each of the blades 32 and 42 that is a predetermined distance (here, the distance σ) from the blade tip (here, the outer peripheral blade tip 50*a*) where the serrated shape 53 is formed. That is, in the method of manufacturing the impeller 7 of the present embodiment, molds (here, the axial-direction-removable molds 71 and 81 and the radial-direction-removable molds 91 to 94) are used such that the step 61 is formed at a position in the blade face of each of the blades 32 and 42 of the impeller 7 after molding that is a predetermined distance (here, the distance σ) from the blade tip (here, the outer peripheral blade tip 50*a*) where the serrated shape 53 is formed, whereby the serrated shape 53 can be formed in the blade tip of each of the blades 32 and 42, and the blades 32 and 42 and the circular support plates 31 and 41 can be injection-molded such that the blades 32 and 42 and the circular support plates 31 and 41 become integrated.

Thus, in the method of manufacturing the impeller 7 of the present embodiment, the impeller 7 having the plurality of blades 32 and 42 on whose blade tips are formed the serrated shapes 53 can be made into one where there are few variations in the positional accuracy of the blades 32 and 42 and where rotational strength is improved, and the number of manufacturing man-hours can be reduced.

(B)

In the method of manufacturing the impeller 7 of the present embodiment, the steps 61 where the steps 97 (that is, the steps 61 of the impeller 7 after molding) are formed so as to extend parallel to the blade tips (here, the outer peripheral blade tips 50*a*) of the blades 32 and 42, so the shapes of the injection molding-use molds (here, the axial-direction-removable molds 71 and 81 and the radial-direction-removable molds 91 to 94) can be made simple; thus, the work of releasing the impeller 7 that has been molded (specifically, the first impeller-configuring body 13 and the second impeller-configuring bodies 14) also becomes easy.

(C)

In the method of manufacturing the impeller 7 of the present embodiment, the steps 97 (that is, the steps 61 of the impeller 7 after molding) are, similar to the relationship between the hypothetical intersection points α and the end-points H of the edges 54*c* in the blades 32 and 42, formed at positions (here, towards the inner peripheral sides) that are farther in the blade width direction from the blade tips (here, the outer peripheral blade tips 50*a*) of the blades 32 and 42 than the end surfaces 96*a* of the serration forming portions 96, so it becomes difficult for burrs to occur at the portions where the serrated shapes 53 have been formed during injection molding.

(D)

In the method of manufacturing the impeller 7 of the present embodiment, the radial-direction-removable molds 91 to 94 that are removed in a direction intersecting the axis of rotation of the axial-direction-removable molds 71 and 81 are used, so during the work of removing the molds, for example, the work of removing the radial-direction-removable molds 91 to 94 in a direction intersecting the axis of rotation may be performed before releasing the first axial-direction-removable mold 71 and the second axial-direction-removable mold 81 in the axis-of-rotation direction or may be performed after releasing the first axial-direction-removable mold 71 and the second axial-direction-removable mold 81 in the axis-of-rotation direction. Moreover, the work of removing the radial-direction-removable molds 91 to 94 in a direction intersecting the axis of rotation may be performed in parallel with and at the same time as the work of releasing the first axial-direction-removable mold 71 and the second axial-direction-removable mold 81 in the axis-of-rotation direction. Further, because the radial-direction-removable molds 91 to 94 comprise plural blocks, handling is easy when one wishes to dispose the blades 32 and 42 on the circular support plates 31 and 41 at an irregular pitch.

(6) Modification 1

Figure 10:
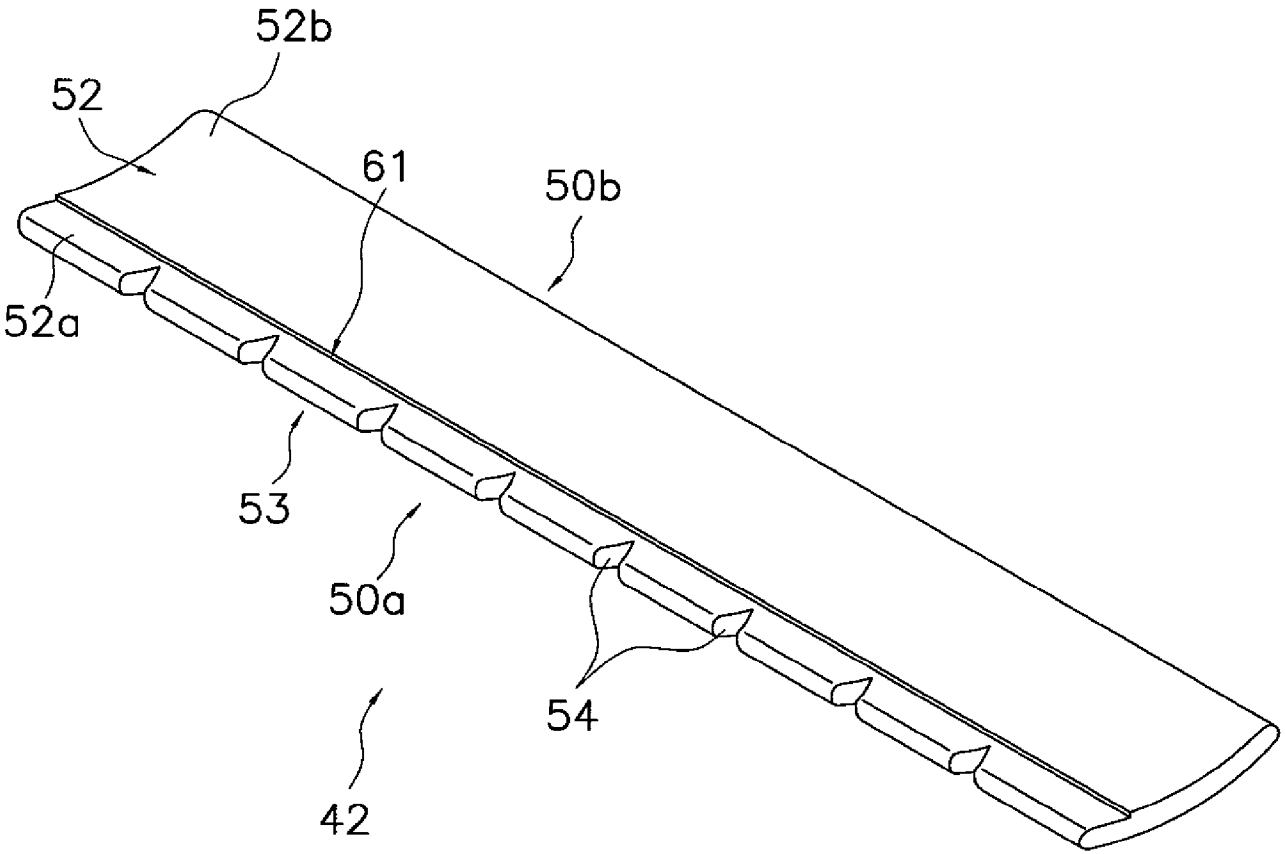
FIG. 10 is an enlarged perspective view showing one of blades that configure an impeller of a multiblade blower pertaining to modification 1 of the present invention.
Figure 11:
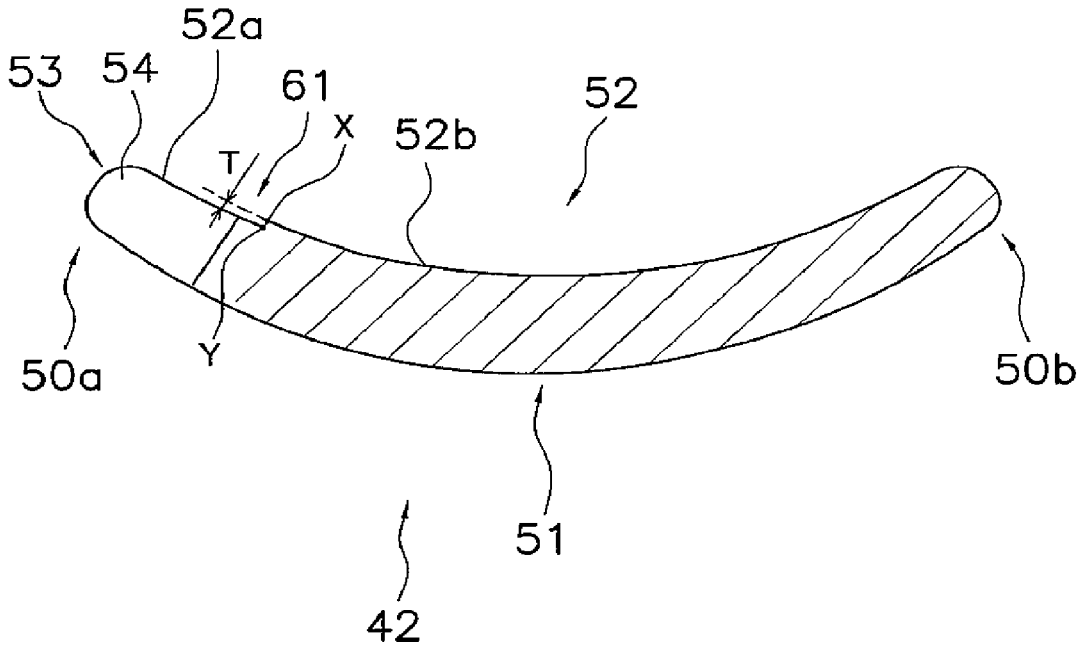
FIG. 11 is a cross-sectional view of the blade that configures the impeller of a multiblade blower pertaining to modification 1 of the present invention.

In the impeller 7 (that is, the first impeller-configuring body 13 and the second impeller-configuring bodies 14) of the preceding embodiment, the step 61 is formed in the rear blade face 51 of each of the blades 32 and 42, but as shown in FIG. 10 and FIG. 11, the step 61 may also be formed in the front blade face 52 of each of the blades 32 and 42. It will be noted that, because the shapes of the blades 32 and 42 are the same as those of the blades 32 and 42 in the preceding embodiment except that the step 61 is formed in the front blade face 52 (thus, the first blade face becomes 52*a* and the second blade face becomes 52*b*), description thereof will be omitted here.

In this case also, similar to the preceding embodiment, effects such as controlling turbulence in the airflow can be obtained.

Figure 12:
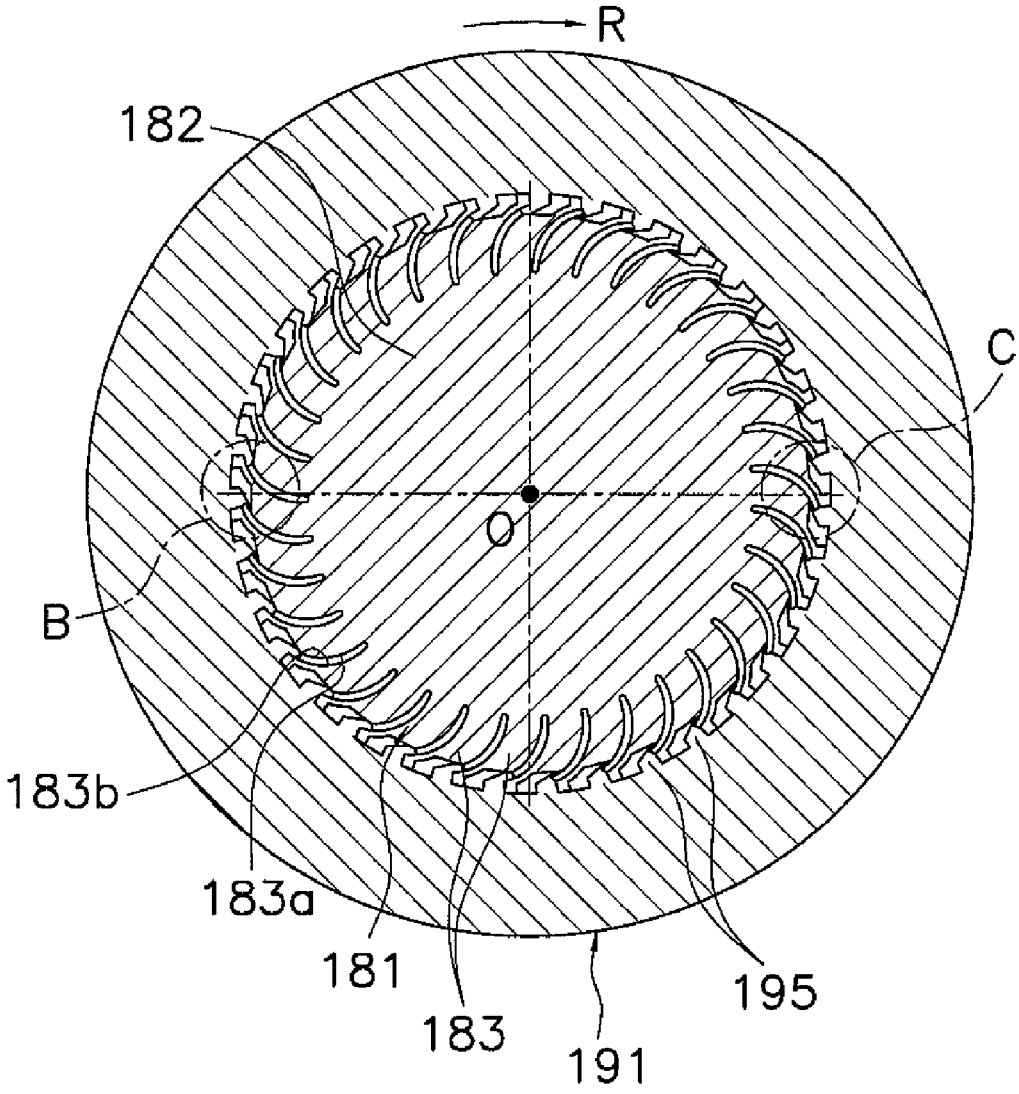
FIG. 12 is a general plan sectional view (with the left half showing a portion corresponding to the cross section along I-I of FIG. 7 and the right half showing a portion corresponding to the cross section along II-II of FIG. 7) showing molds for injection-molding the second impeller-configuring bodies that configure the impeller.
Figure 13:
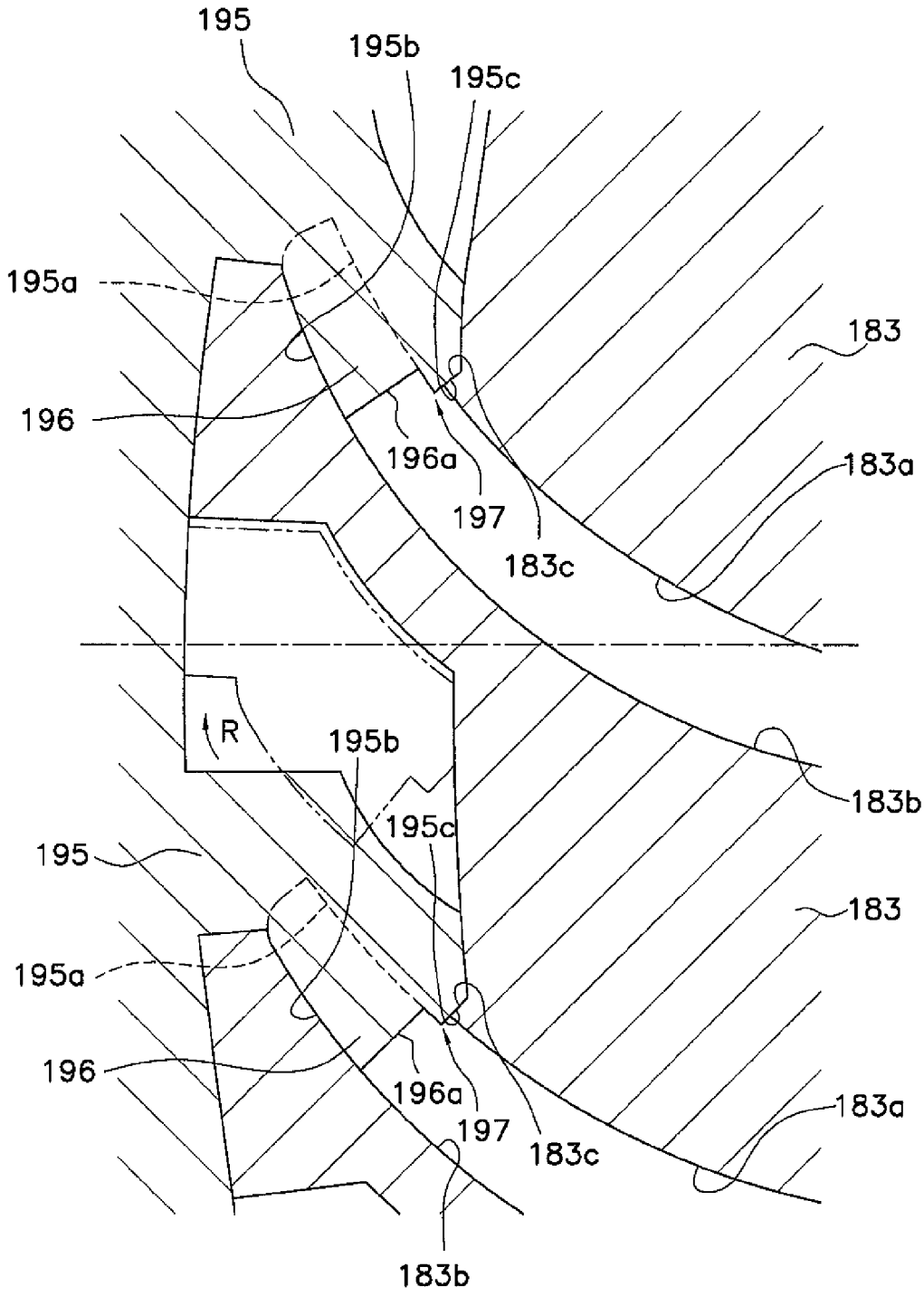
FIG. 13 is an enlarged view showing portion B of FIG. 12.
Figure 14:
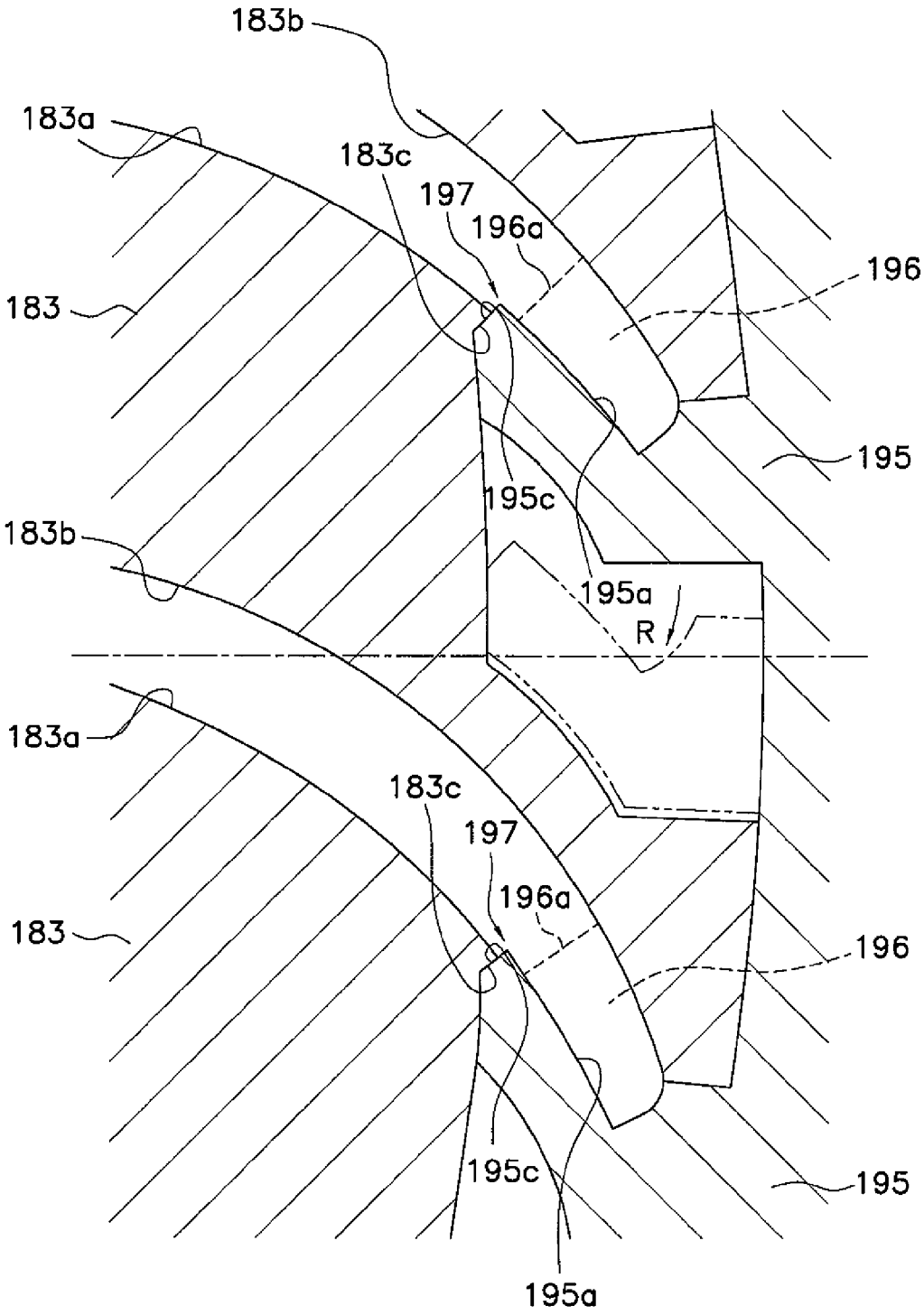
FIG. 14 is an enlarged view showing portion C of FIG. 12.

Further, a method of manufacturing the impeller 7 (that is, the first impeller-configuring body 13 and the second impeller-configuring bodies 14) where the step 61 is formed in the front blade face 52 of each of the blades 32 and 42 as in the present modification will be described using FIG. 12 to FIG. 14. Here, FIG. 12 is a general plan sectional view (with the left half showing a portion corresponding to the cross section along I-I of FIG. 7 and the right half showing a portion corresponding to the cross section along II-II of FIG. 7) showing molds for injection-molding the second impeller-configuring bodies 14 that configure the impeller 7. FIG. 13 is an enlarged view showing portion B of FIG. 12. FIG. 14 is an enlarged view showing portion C of FIG. 12.

The method of manufacturing the impeller 7 is, similar to that of the preceding embodiment, mainly configured by a preparation step, a joining step, and an adjustment step. It will be noted that, because the method is the same as the method of manufacturing the impeller 7 of the preceding embodiment except for the injection molding of the first impeller-configuring body 13 and the second impeller-configuring bodies 14 in the preparation step, description thereof will be omitted here.

Next, injection molding of the first impeller-configuring body 13 and the second impeller-configuring bodies 14 will be described in detail using the second impeller-configuring bodies 14 as an example.

The method of injection-molding the second impeller-configuring bodies 14 uses a pair of axial-direction-removable molds 71 and 181 and a circumferential-direction-removable mold 191 to integrally injection-mold the circular support plate 41 and the plural blades 42 on whose blade tips the serrated shapes 53 are formed, and is disposed with a step of forming a cavity into which a resin is injected by the pair of axial-direction-removable molds 71 and 181 and the circumferential-direction-removable mold 191, a step of injecting the resin inside the cavity, and a step of rotating and removing the circumferential-direction-removable mold 191 about the axis of rotation with respect to the pair of axial-direction-removable molds 71 and 181 after the resin has solidified inside the cavity.

Here, the pair of axial-direction-removable molds 71 and 181 and the circumferential-direction-removable mold 191 will be described.

The first axial-direction-removable mold 71 that is one of the pair of axial-direction-removable molds 71 and 181 is the same as the first axial-direction-removable mold 71 in the preceding embodiment, so description thereof will be omitted (see FIG. 7). The second axial-direction-removable mold 181 that is the other of the pair of axial-direction-removable molds 71 and 181 is, similar to the second axial-direction-removable mold 81 of the preceding embodiment, disposed so as to face the first axial-direction-removable mold 71 in the axis-of-rotation direction, and is a mold that can be removed in the axis-of-rotation direction with respect to the first axial-direction-removable mold 71 after the resin has solidified (see FIG. 7). Additionally, the second axial-direction-removable mold 181 includes, similar to the second axial-direction-removable mold 81 of the preceding embodiment, an axial-direction projecting portion 182 that projects in a circular column shape towards the first axial-direction-removable mold 71 about the axis-of-rotation line O (see FIG. 7).

Further, plural radial-direction projecting portions 183 that project from the outer peripheral edge of the axial-direction projecting portion 182 towards the outer peripheral side while slanting in the circumferential direction towards the outer peripheral side are formed in the second axial-direction-removable mold 181. Each of the radial-direction projecting portions 183 is formed so as to extend uniformly from one end of the radial-direction projecting portion 182 to the other end in the axis-of-rotation direction. The radial-direction projecting portions 183 are disposed side-by-side in the circumferential direction, and a cavity for forming part of the blades 42 including inner peripheral blade tips 50*b* (see FIGS. 10 and 11) is formed between the radial-direction projecting portions 183 that are mutually adjacent in the circumferential direction. More specifically, each of the radial-direction projecting portions 183 includes a second front blade face forming surface 183*a* that forms the second blade face 52*b* (see FIGS. 10 and 11) that is part of the front blade face 52 of each of the blades 42, a rear blade face forming surface 183*b* whose inner peripheral end is connected to the inner peripheral end of the second front blade face forming surface 183*a* and which forms the rear blade face 51 (see FIGS. 10 and 11) of each of the blades 42, and a second matching surface 183*c* that is connected, so as to be substantially orthogonal when seen in a plan view, with respect to the second front blade face forming surface 183*a* from the outer peripheral end of the second front blade face forming surface 183*a*. In this manner, the radial-direction projecting portions 183 are mainly portions for forming the outer peripheral portion of the circular support plate 41 (specifically, the portions between the blades 42 in the circumferential direction) and the portion of the blade face of each of the blades 42 excluding the portion to a position a predetermined distance (here, the distance σ) from the blade tip (here, the outer peripheral blade tip 50*a*) where the serrated shape 53 is formed.

The circumferential-direction-removable mold 191 is an annular portion disposed so as to be relatively rotatable with respect to the axial-direction-removable molds 71 and 181, and is a mold that can be removed in the circumferential direction (here, the R direction) with respect to the axial-direction-removable molds 71 and 181 (here, the second axial-direction-removable mold 181) after the resin has solidified.

Plural blade tip forming portions 195 that project towards the inner peripheral side so as to correspond to the cavity formed by the radial-direction projecting portions 183 of the second axial-direction-removable mold 181 are formed on the inner peripheral edge of the circumferential-direction-removable mold 191. Each of the blade tip forming portions 195 is formed so as to extend uniformly from one end of the radial-direction projecting portions 183 of the second axial-direction-removable mold 181 in the axis-of-rotation direction towards the other end. Each of the blade tip forming portions 195 includes a first front blade face forming surface 195*a* that forms the first blade face 52*a* (see FIGS. 10 and 11) that is part of the front blade face 52 of each of the blades 42, an adhesive surface 195*b* that adheres to the rear blade face forming surface 183*a*, and a first matching surface 195*c* that is connected, so as to be substantially orthogonal when seen in a plan view, with respect to the first front blade face forming surface 195*a* from the inner peripheral end of the first front blade face forming surface 195*a*. In this manner, the blade tip forming portions 195 are mainly portions for forming the outer peripheral portion of the circular support plate 41 (specifically, the portion further on the outer peripheral side than the outer peripheral ends of the blades 42) and the portion (excluding the cutout portions 54) of the blade face of each of the blades 42 to a position a predetermined distance (here, the distance σ) from the blade tip (here, the outer peripheral blade tip 50*a*) where the serrated shape 53 is formed.

Further, plural serration forming portions 196 for forming the cutout portions (see FIG. 10, FIG. 11 and FIG. 6) of the serrated shapes 53 of the blade tips (here, the outer peripheral blade tips 50*a*) of the blades 42 are formed on each of the blade tip forming portions 195. Each of the serration forming portions 196 is a portion that protrudes towards the inner peripheral side along the rear blade face forming surface 183*b* of the second axial-direction-removable mold 181 and the first front blade face forming surface 195*a* from a position corresponding to the blade tip (here, the outer peripheral blade tip 50*a*) of the blade 42 at a predetermined interval (that is, the pitch P of the cutout portions 54) in the axis-of-rotation direction in order to form the cutout portions 54 that configure the serrated shapes 53 of the blades 42, and has the same triangular shape as that of the cutout portions 54 when the circumferential-direction-removable mold 191 is seen in a cross-sectional view (see FIG. 10, FIG. 11 and FIG. 6). That is, a triangular end surface 196*a* of each of the serration forming portions 196 when the circumferential-direction-removable mold 191 is seen in a cross-sectional view has a rounded shape similar to the sides 54*c* of the blades 42. In this manner, the serration forming portions 196 are mainly portions for forming the cutout portions 54 that configure the serrated shapes 53.

Moreover, the outer peripheral portions of the radial-direction projecting portions 183 of the second axial-direction-removable mold 181 are largely cut out such that the blade tip forming portions 195 and the serration forming portions 196 of the circumferential-direction-removable mold 191 are rotatable in the circumferential direction (here, the R direction) with respect to the radial-direction projecting portions 183.

That is, when the circumferential-direction-removable mold 191 is disposed so as to be relatively rotatable with respect to the axial-direction-removable molds 171 and 181, the adhesive surfaces 195*b* adhere to the rear blade face forming surfaces 183*b*, the first matching surfaces 195*c* adhere to the second matching surfaces 183*c*, and a cavity for forming the blades 42 on whose blade tips (here, the outer peripheral blade tips 50*a*) are formed the serrated shapes 53 is formed. Here, the first blade faces 52*a* that configure the front blade faces 52 of the blades 42 are formed by the circumferential-direction-removable mold 191, and the second blade faces 52*b* that configure the front blade faces 52 of the blades 42 are formed by the second axial-direction-removable mold 181, so steps 197 corresponding to the matching surfaces (specifically, the first matching surfaces 195*c* and the second matching surfaces 183*c* that face each other in the radial direction) between the second axial-direction-removable mold 181 and the circumferential-direction-removable mold 191 are formed. The steps 197 correspond to the steps 61 (see FIGS. 10 and 11) of the blades 42, and the second axial-direction-removable mold 181 and the circumferential-direction-removable mold 191 are manufactured such that the distance, in the blade thickness direction, between the first front blade face forming surfaces 195*a* that form the first blade faces 52*a* and the second front blade face forming surfaces 183*a* that form the second blade faces 52*b* falls within the distance T (see FIG. 11). Further, the second axial-direction-removable mold 181 and the circumferential-direction-removable mold 191 are manufactured such that the first front blade face forming surfaces 195*a* are recessed towards the rear blade face forming surfaces 183*b* with respect to the second front blade face forming surfaces 183*a*. Moreover, the second axial-direction-removable mold 181 and the circumferential-direction-removable mold 191 are manufactured such that, similar to the relationship between the hypothetical intersection points α and the endpoints H of the edges 54*c* in the blades 42, the steps 197 are formed at positions (here, the inner peripheral sides) farther in the blade width direction from the blade tips (here, the outer peripheral blade tips 50*a*) of the blades 42 than the end surfaces 196*a* of the serration forming portions 196.

Using the axial-direction-removable molds 71 and 181 and the circumferential-direction-removable mold 191, first, the circumferential-direction-removable mold 191 is fitted together with the second axial-direction-removable mold 181 from the axis-of-rotation direction, and the first axial-direction-removable mold 71 and the second axial-direction-removable mold 181 are put together in the axis-of-rotation direction, whereby a cavity is formed where the circular support plate 41 and the plural blades 42 are integrated. At this time, as mentioned above, the steps 197 are formed between the first front blade face forming surfaces 195*a* and the second front blade face forming surfaces 183*a*.

Next, a resin is injected from a gate or the like (not shown) into the cavity formed by the axial-direction-removable molds 71 and 181 and the circumferential-direction-removable mold 191, and the resin is allowed to solidify inside the cavity.

Then, the circumferential-direction-removable mold 191 is rotated about the axis-of-rotation (here, the R direction) with respect to the second axial-direction-removable mold 181, whereby the circumferential-direction-removable mold 191 is removed such that the serration forming portions 196 of the circumferential-direction-removable mold 191 and the resin portions that have solidified inside the cavity and form the serrated shapes 53 do not overlap when the circumferential-direction-removable mold 191 is seen in a plan view, and the first axial-direction-removable mold 71 and the second axial-direction-removable mold 181 are released in the axis-of-rotation direction, whereby the second impeller-configuring body 14 is released.

In this manner, the circular support plate 41 and the plural blades 42 on whose blade tips are formed the serrated shapes 53 can be integrally injection-molded.

Further, in regard to the first impeller-configuring body 13, the shape of the circular support plate 31 is different from the shape of the circular support plates 41 of the second impeller bodies 14, so the shapes of the axial-direction-removable molds 71 and 181 are slightly different. However, because the shape of the blades 32 is the same as that of the blades 42 of the second impeller-configuring bodies 14 and the shape of the circumferential-direction-removable mold 191 and the relationship between the circumferential-direction-removable mold 191 and the axial-direction-removable molds 71 and 181 are the same, the circular support plate 31 and the plural blades 32 on whose blade tips are formed the serrated shapes 53 can, similar to the second impeller-configuring bodies 14, be integrally injection-molded.

In the method of manufacturing the impeller 7 of the present modification also, the impeller 7 having the plurality of blades 32 and 42 on whose blade tips are formed the serrated shapes 53 can be made into one where there are few variations in the positional accuracy of the blades 32 and 42 and where rotational strength is improved, and the number of manufacturing man-hours can be reduced.

(7) Modification 2

In the impeller 7 (that is, the first impeller-configuring body 13 and the second impeller-configuring bodies 14) of the preceding embodiment and modification 1, the serrated shape 53 is formed on the outer peripheral blade tip 50*a* of each of the blades 32 and 42, but the serrated shape 53 may also be formed on the inner peripheral blade tip 50*b* of each of the blades 32 and 42.

Figure 15:
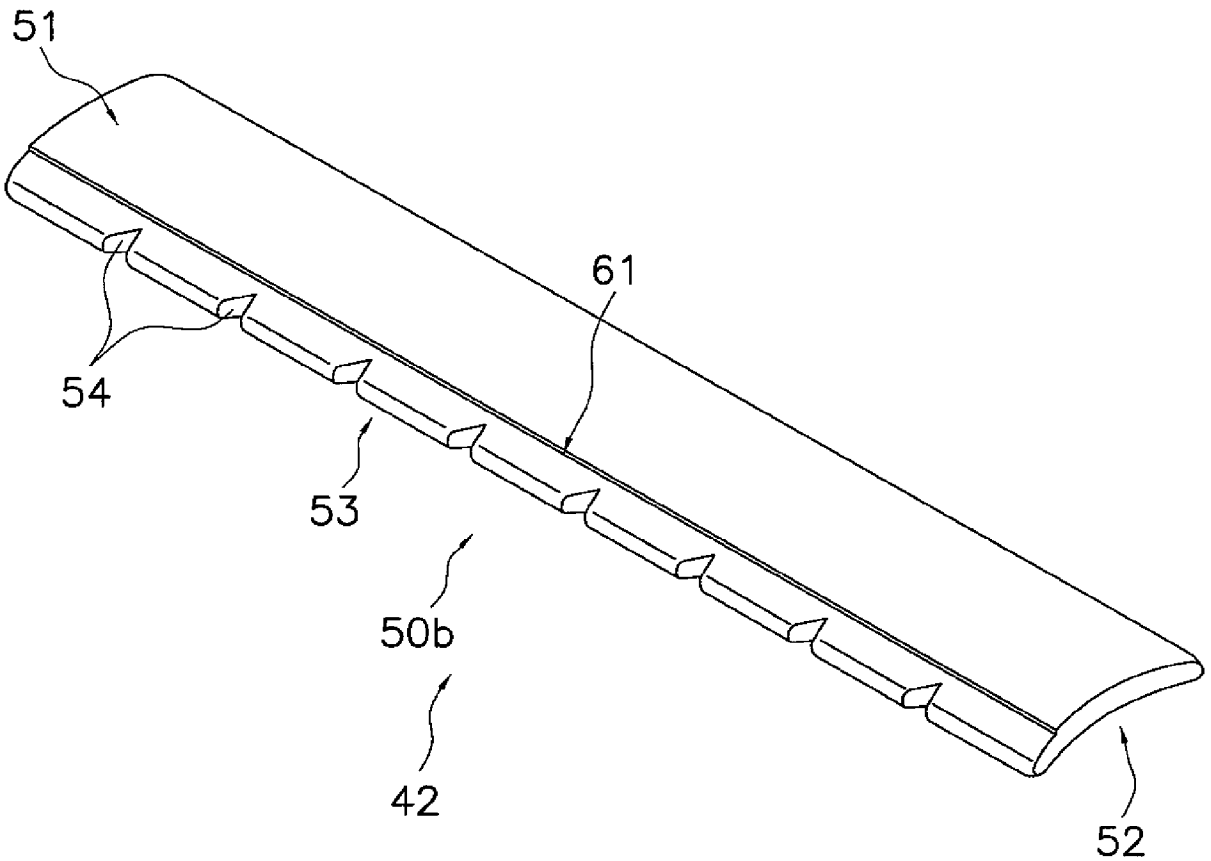
FIG. 15 is an enlarged perspective view showing one of blades that configure an impeller of a multiblade blower pertaining to modification 2 of the present invention.

To describe this using the second impeller-configuring bodies 14 as an example, as shown in FIG. 15, the serrated shape 53 can be formed on the inner peripheral blade tip 50*b* of each of the blades 42.

When the second impeller-configuring body 14 is injection-molded, the outer peripheral portions of the blades 42 (specifically, the portions excluding portions to positions a predetermined distance (e.g., the distance σ) from the inner peripheral blade tips 50*b* of the blades 42) are formed by the second axial-direction-removable mold 181, and the radial-direction-removable molds 91 to 94 are disposed on the inner peripheral sides of the blades 42 to form the portions a predetermined distance (e.g., the distance σ) from the inner peripheral blade tips 50*b* of the blades 42. Then, in this case, the step 61 is formed at a position on the blade face (here, the rear blade face 51*b*) of each of the blades 42 that is a predetermined distance (e.g., the distance σ) from the blade tip (here, the inner peripheral blade tip 50*b*) where the serrated shape 53 is formed.

In this manner, when the serrated shape 53 is formed on the inner peripheral blade tip 50*b* of each of the blades 32 and 42, when air is sucked inside the impeller 7 from the space S1 (see FIG. 1), horizontal vortexes whose scale is large and which are discharged from the outer peripheral blade tips 50*a* of the blades 32 and 42 become broken down into organized, stable horizontal vortexes whose scale is small by the vertical vortexes formed at the cutout portions 54, and noise can be reduced. Further, when air is blown out into the space S2 from the inside of the impeller 7 (see FIG. 1), separation of the airflow at the blade faces (particularly the rear blade faces 51) of the blades 32 and 42 can be controlled by the vertical vortexes formed at the cutout portions 54 that configure the serrated shapes 53, and noise can be reduced.

It will be noted that, although it is not shown, it is also possible to form the serrated shape 53 on the inner peripheral blade tip 50*b* of each of the blades 42 using the second axial-direction-removable mold 181 and the circumferential-direction-removable mold 191. Additionally, in this case, the steps 61 become formed in the front blade faces 52.

Moreover, in order to obtain both the noise reducing effect when the serrated shapes 53 are disposed on the outer peripheral blade tips 50*a* and the noise reducing effect when the serrated shapes 53 are disposed on the inner peripheral blade tips 50*b*, the serrated shapes 53 may also be formed on the outer peripheral blade tips 50*a* and the inner peripheral blade tips 50*b* of the blades 32 and 42.

Figure 16:
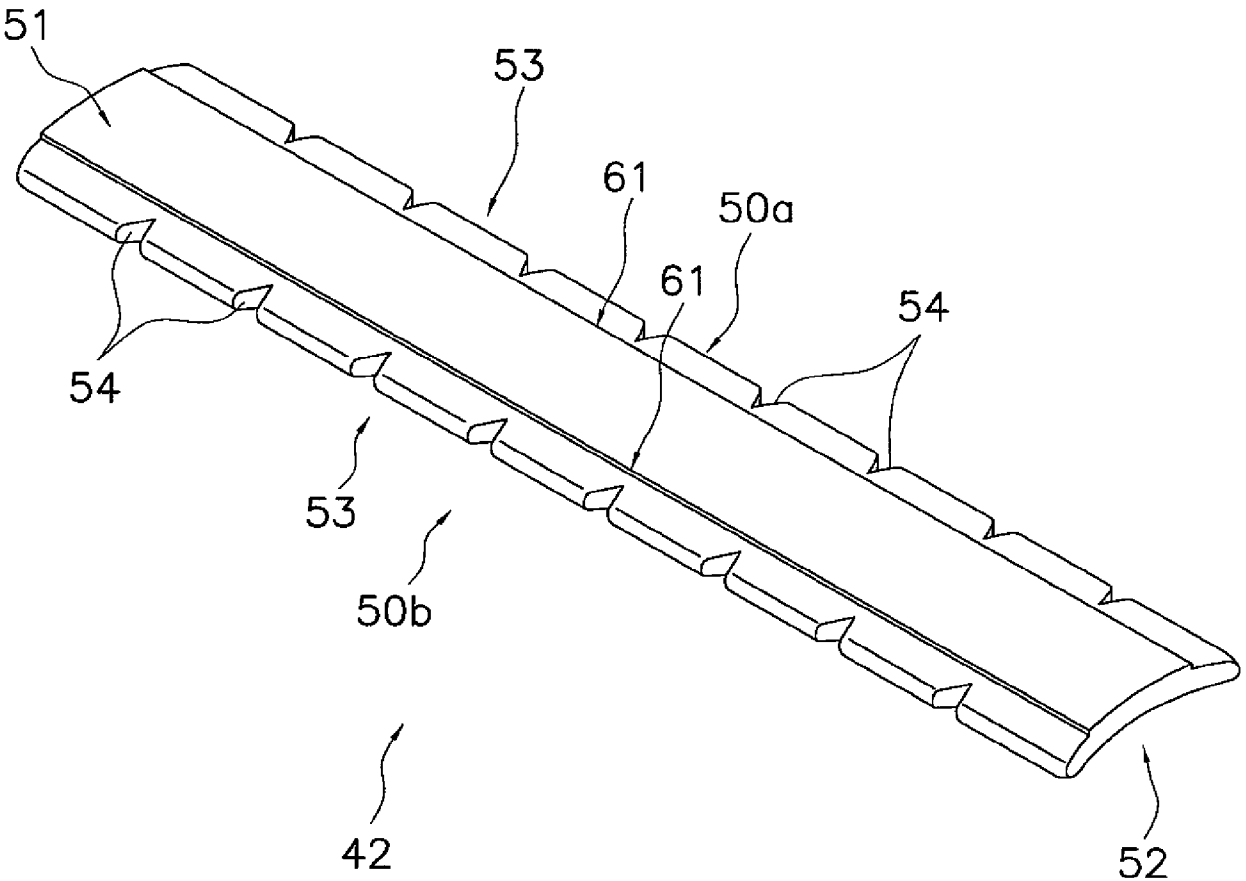
FIG. 16 is an enlarged perspective view showing one of the blades that configure the impeller of a multiblade blower pertaining to modification 2 of the present invention.

To describe this using the second impeller-configuring bodies 14 as an example, as shown in FIG. 16, the serrated shape 53 can be formed on the outer peripheral blade tip 50*a* of each of the blades 42, and the serrated shape 53 can be formed on the inner peripheral blade tip 50*b* of each of the blades 42.

When such a second impeller-configuring body 14 is injection-molded, the position of the blade width direction center portion of the blade 42 (specifically, the portion of the blade 42 excluding both the portion to a position a predetermined distance (e.g., the distance a) from the outer peripheral blade tip 50*a* of the blade 42 and the portion to a position a predetermined distance (e.g., the distance σ) from the inner peripheral blade tip 50*b* of the blade 42) is formed by the second axial-direction-removable mold 181, the radial-direction-removable molds 91 to 94 are disposed on both the outer peripheral side and the inner peripheral side of the blade 42, and the portion to a position a predetermined distance (e.g., the distance σ) from the outer peripheral blade tip 50*a* and the inner peripheral blade tip 50*b* of the blade 42 is formed. Additionally, in this case, two of the steps 61 become formed at positions in the blade face of each of the blades 42 that are a predetermined distance (e.g., the distance σ) from the blade tips (here, the outer peripheral blade tip 50*a* and the inner peripheral blade tip 50*b*) where the serrated shapes 53 are formed.

It will be noted that, although it is not shown, it is also possible to form the serrated shapes 53 on the outer peripheral blade tip 50*a* and the inner peripheral blade tip 50*b* of the blade 42 using the second axial-direction-removable mold 181 and the circumferential-direction-removable mold 191. Additionally, in this case, the two steps 61 become formed in the front blade face 52.

(8) Modification 3

Figure 17:
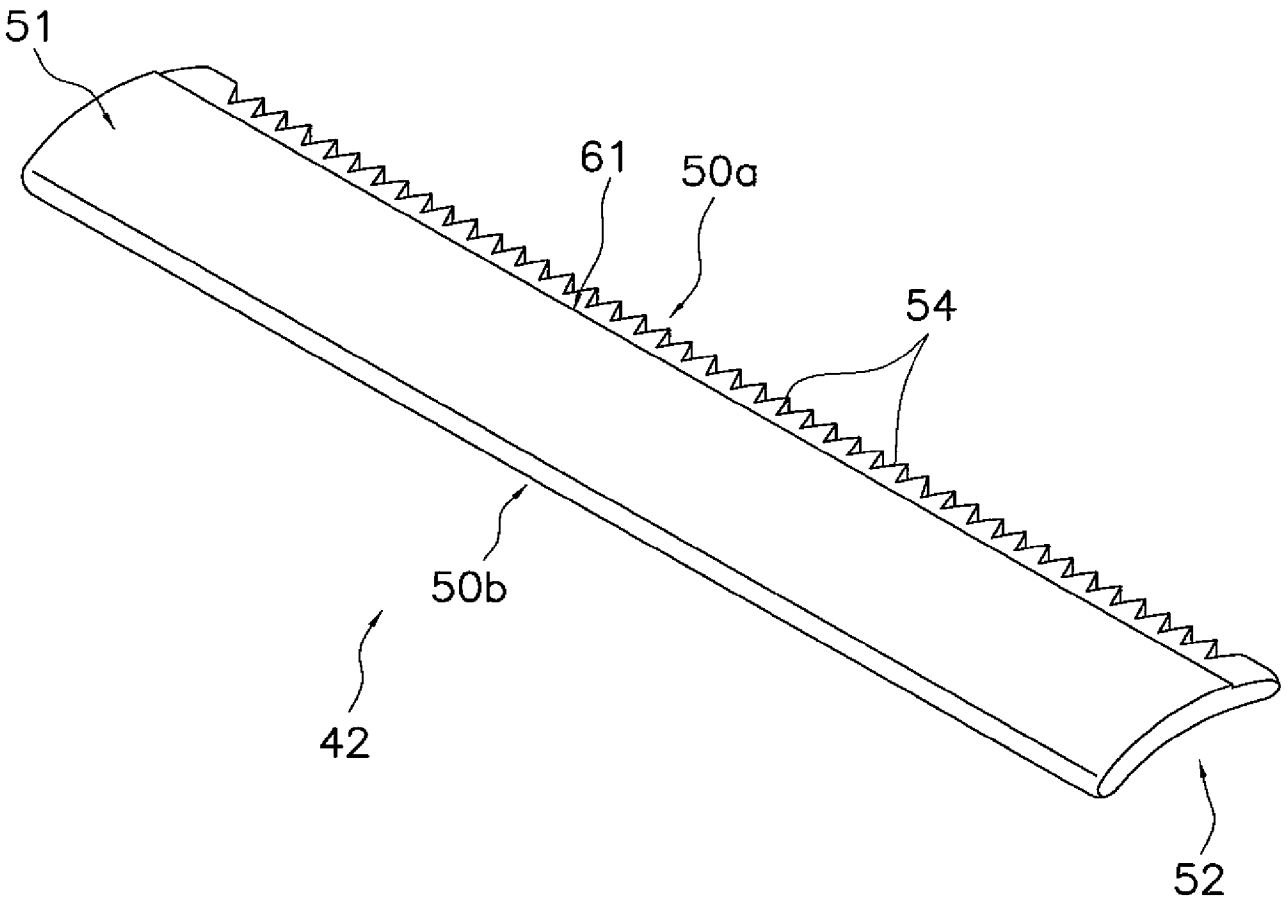
FIG. 17 is an enlarged perspective view showing one of blades that configure an impeller of a multiblade blower pertaining to modification 3 of the present invention.

In the impeller 7 (that is, the first impeller-configuring body 13 and the second impeller-configuring bodies 14) of the preceding embodiment and modifications 1 and 2, the cutout portions 54 and the smooth portions 55 configuring the serrated shapes 53 formed on the blade tips of the blades 32 and 42 were alternately disposed in the longitudinal direction of the blades 32 and 42, but as shown in FIG. 17, for example, the serrated shapes 53 may also have a structure comprising just the cutout portions 54 (that is, such that the serrated shapes do not include the smooth portions 55 between the cutout portions 54 in the longitudinal direction).

(9) Other Embodiments

Embodiments of the present invention have been described above on the basis of the drawings, but the specific configuration thereof is not limited to these embodiments and is alterable in a range that does not depart from the gist of the invention.

(A)

In the preceding embodiment and its modifications, the present invention was applied to the first impeller-configuring body 13 and the second impeller-configuring bodies 14 that configure the impeller 7 of the blower 4 comprising a cross-flow fan serving as an example of a multiblade blower, but it is also possible to apply the present invention to other multi-blade blower impellers, such as a sirocco fan impeller.

(B)

In the preceding embodiment and its modifications, the cutout portions 54 had triangular shapes, but they may also have other shapes such as a U-shape or a quadrangular shape.

Industrial Applicability

By using the present invention, an impeller of a multiblade blower having a plurality of blades on whose blade tips are formed serrated shapes can be made into one where there are few variations in the positional accuracy of the blades and where rotational strength is improved, and the number of manufacturing man-hours can be reduced.

What is claimed is:

1. An impeller of a multiblade blower comprising:

a plurality of circular support plates that rotate about an axis of rotation, each of the support plates having an outer peripheral portion and being constructed of resin; and a plurality of blades disposed on the outer peripheral portion of each of the circular support plates so as to be parallel to he axis of rotation, each of the blades being constructed of resin, each of the blades haying a tip with a plurality of cutouts to form a serrated shape and a step formed in a blade face at a position that is spaced a predetermined distance from the blade tip having the serrated shape, each cutout of each blade having a triangular shape with a pair of sides connected to each other at an inner peripheral side of the cutout, the two sides being inclined relative to each other such that straight lines extending along the two sides in a blade width direction from the blade tip intersect with each other at an intersection point, and the predetermined distance corresponding to a distance from the blade tip having the serrated shape to the intersection point.

2. The impeller of a multiblade blower of claim 1, wherein each blade face in which the step is formed has a first blade face portion leading from the step to the blade tip having the serrated shape and a second blade face portion leading from the step away from the blade tip having the serrated shape, and a distance between the first blade face portion and the second blade face portion is no larger than 0.05 mm as measured in a blade thickness direction of each blade.

3. The impeller of a multiblade blower of claim 1, wherein each blade face in which the step is formed has a first blade face portion leading from the step to the blade tip having the serrated shape and a second blade face portion leading from the step away from the blade tip having the serrated shape, and the first blade face portion is recessed in a blade thickness direction of each blade with respect to the second blade face portion where the step is formed.

4. The impeller of a multiblade blower of claim 1, wherein the step of each blade is formed so as to extend parallel to the blade tip of the blade.

5. The impeller of a multibiade blower of claim 1, wherein each blade has a pair of oppositely facing blade faces with the step being formed just in one blade face of each of the blades.

6. The impeller of a multiblade blower of claim 1, wherein each cutout portion includes an open end and an inner endpoint forming an inner peripheral edge of the cutout, and the step of each blade is spaced in a blade width direction from the inner peripheral edges of the cutouts of the blade in a direction away from the blade tip having the serrated shape.

7. A method of manufacturing an impeller of a multiblade blower having circular support plates that are made of a resin and rotate about an axis of rotation and a plurality of blades that are made of a resin and are disposed on outer peripheral portions of the circular support plates so as to be parallel to the axis of rotation, each blade having a plurality of cutouts formed in a blade tip to form a serrated shape, each cutout of each blade having a triangular shape with a pair of sides connected to each other at an inner peripheral side of the cutout, the two sides being inclined relative to each other such that straight lines extending along the two sides in a blade width direction from the blade tip intersect with each other at an intersection point, and the predetermined distance corresponding to a distance from the blade tip having the serrated shape to the intersection point, the method comprising:

forming a cavity configured to receive a resin, the cavity being formed by providing axial-direction-removable molds and radial-direction removable molds, the axial-direction removable molds being configured to form portions of blade faces of the blades excluding blade face portions extending to positions a predetermined distance from the blade tips having serrated shapes, the radial-direction-removable molds being disposed to face the axial-direction -removable molds in a direction intersecting the axis-of-rotation direction and which are configured to form the blade face portions of the blade faces of the blades to the positions the predetermined distance from the blade tips having the serrated shapes;

injecting the resin inside the cavity; and removing the radial-direction-removable molds in the a direction intersecting the axis-of-rotation direction with respect to the axial-direction-removable molds after the resin has solidified inside the cavity.

8. A method of manufacturing an impeller of a multiblade blower having circular support plates that are made of a resin and rotate about an axis of rotation and a plurality of blades that are made of a resin and are disposed on outer peripheral portions of the circular support plates so as to be parallel to the axis of rotation, each blade having a plurality of cutouts formed in a blade tip to form a serrated shape, each cutout of each blade having a triangular shape with a pair of sides connected to each other at an inner peripheral side of the cutout, the two sides being inclined relative to each other such that straight lines extending along the two sides in a blade width direction from the blade tip intersect with each other at an intersection point, and the predetermined distance corresponding to a distance from the blade tip having the serrated shape to the intersection point, the method comprising:

forming a cavity configured to receive a resin, the cavity being formed by providing axial-direction-removable molds and a circumferential-direction-removable mold, the axial-direction removable molds being configured to form portions of blade faces of the blades excluding blade face portions extending to positions a predetermined distance from the blade tips having serrated shapes, the circumferential-direction-removable mold being disposed so as to be relatively rotatable with respect to the axial-direction-removable molds and which is configured to form the blade face portions of the blade faces of the blades to the positions the predetermined distance from the blade tips having the serrated shapes;

injecting the resin inside the cavity; and rotating and removing the circumferential-direction-removable mold about the axis of rotation with respect to the axial-direction-removable molds after the resin has solidified inside the cavity.

9. The impeller of a multiblade blower of claim 2, wherein the first blade face portion is recessed in a blade thickness direction of each blade with respect to the second blade face portion where the step is formed.

10. The impeller of a multiblade blower of claim 2, wherein the step of each blade is formed so as to extend parallel to the blade tip of the blade.

11. The impeller of a multiblade blower of claim 2, wherein each blade has a pair of oppositely facing blade faces with the step being formed just in one blade face of each of the blades.

12. The impeller of a multiblade blower of claim 2, wherein each cutout portion includes an open end and an inner endpoint forming an inner peripheral edge of the cutout, and the step of each blade is spaced in a blade width direction from the inner peripheral edges of the cutouts of the blade in a direction away from the blade tip having the serrated shape.

13. The impeller of a multiblade blower of claim 3, wherein the step of each blade is formed so as to extend parallel to the blade tip of the blade.

14. The impeller of a multiblade blower of claim 3, wherein each blade has a pair of oppositely facing blade faces with the step being formed just in one blade face of each of the blades.

15. The impeller of a multiblade blower of claim 3, wherein each cutout portion includes an open end and an inner endpoint forming an inner peripheral edge of the cutout, and the step of each blade is spaced in a blade width direction from the inner peripheral edges of the cutouts of the blade in a direction away from the blade tip having the serrated shape.

* * * * *